US007140796B2

(12) United States Patent
Matsuo et al.

(10) Patent No.: US 7,140,796 B2
(45) Date of Patent: Nov. 28, 2006

(54) RECORDING APPARATUS

(75) Inventors: Hiroyuki Matsuo, Osaka (JP); Koji Ikeda, Hyogo (JP); Masaichiro Tatekawa, Osaka (JP); Yosuke Toyofuku, Fukuoka (JP); Hideaki Horio, Fukuoka (JP); Kazuyuki Nakashima, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 16 days.

(21) Appl. No.: 10/999,844

(22) Filed: Nov. 30, 2004

(65) Prior Publication Data

US 2005/0093954 A1 May 5, 2005

Related U.S. Application Data

(62) Division of application No. 10/278,616, filed on Oct. 23, 2002, now Pat. No. 6,848,850.

(30) Foreign Application Priority Data

| | | |
|---|---|---|
| Oct. 24, 2001 | (JP) | 2001-326932 |
| Mar. 5, 2002 | (JP) | 2002-058735 |
| Mar. 5, 2002 | (JP) | 2002-058761 |
| Mar. 5, 2002 | (JP) | 2002-058990 |
| Jun. 21, 2002 | (JP) | 2002-180971 |

(51) Int. Cl.
*B41J 29/00* (2006.01)

(52) U.S. Cl. ..... 400/693; 400/624; 400/625; 347/108

(58) Field of Classification Search ..... 400/693; 347/108

See application file for complete search history.

(56) References Cited

U.S. PATENT DOCUMENTS

| | | | | |
|---|---|---|---|---|
| 4,903,956 | A | 2/1990 | Stephens et al. | 271/178 |
| 5,248,210 | A | 9/1993 | Schulz | 400/625 |
| 5,409,209 | A | 4/1995 | Nakamura et al. | 271/271 |
| 6,457,888 | B1 | 10/2002 | Matsumoto | 400/625 |
| 6,848,850 | B1 * | 2/2005 | Matsuo et al. | 400/693 |

FOREIGN PATENT DOCUMENTS

| | | | |
|---|---|---|---|
| JP | 59039573 | A | 3/1984 |
| JP | 63137872 | A | 6/1988 |
| JP | 63-251262 | | 10/1988 |
| JP | 02106551 | A | 4/1990 |
| JP | 04339678 | A | 11/1992 |
| JP | 05057975 | A * | 3/1993 |

(Continued)

OTHER PUBLICATIONS

Machine translation of JP 2001-106344 to Ishikita et al. from Japanese Patent Office website.*

*Primary Examiner*—Daniel J. Colilla
(74) *Attorney, Agent, or Firm*—Harness, Dickey & Pierce, P.L.C.

(57) ABSTRACT

A printer includes: a recording section for recording information on a recording medium; a medium carrying mechanism for carrying the recording medium on which information has been recorded by the recording section; a medium accommodating section extending in a vertical direction or in a slanted vertical direction for accommodating the recording medium carried by the medium carrying mechanism; and pusher means for pushing the recording medium carried by the medium carrying mechanism into the medium accommodating section.

1 Claim, 25 Drawing Sheets

FOREIGN PATENT DOCUMENTS

| | | | | |
|---|---|---|---|---|
| JP | 05301398 | A | * | 11/1993 |
| JP | 06202395 | A | | 7/1994 |
| JP | 08-002769 | | | 1/1996 |
| JP | 08-113411 | | | 5/1996 |
| JP | 09278247 | A | | 10/1997 |
| JP | 11334963 | A | | 12/1999 |
| JP | 2000044104 | A | | 2/2000 |
| JP | 2000181167 | A | | 6/2000 |
| JP | 2000326588 | A | | 11/2000 |
| JP | 2001106344 | A | | 4/2001 |
| JP | 2001315409 | A | | 11/2001 |
| JP | 2002086841 | A | | 3/2002 |
| JP | 2002103717 | A | | 4/2002 |

* cited by examiner

RECORDING APPARATUS

CROSS-REFERENCE TO RELATED APPLICATIONS

This application is a divisional of U.S. patent application Ser. No. 10/278,616 filed on Oct. 23, 2002 now U.S. Pat. No. 6,848,850. The disclosure(s) of the above application(s) is (are) incorporated herein by reference. This application also claims the benefit of Japanese Patent Application Nos. 2002-180971 filed Jun. 21, 2002; 2001-326932 filed Oct. 24, 2001; 2002-058735 filed Mar. 5, 2002; 2002-058761 filed Mar. 5, 2002; and 2002-058990 filed Mar. 5, 2002. The disclosure(s) of the above application(s) are incorporated herein by reference.

FIELD OF THE INVENTION

The present invention relates to a recording apparatus.

BACKGROUND OF THE INVENTION

As illustrated in FIG. 29A, a printer 200 of a common type includes a paper supply tray 202 on top of a printer body 201, and a paper eject tray 203 on the front side of the printer body 201.

Moreover, as illustrated in FIG. 30, the printer 200 includes a paper supply section 205, a recording section 207 and a paper eject section 206. The paper supply section 205 includes the paper supply tray 202 and a pickup roller 210. The recording section 207 includes a pinch roller 215, a drive roller 214, an ink tank 216, an ink jet head 218 and a platen 222. The paper eject section 206 includes a roller 224, a paper eject roller 226 and the paper eject tray 203. The paper eject tray 203 is provided at a position that is lower than the paper eject roller 226. The angle ("paper path angle") θ between the paper carrying direction A in which recording paper 240 is carried in the recording section 207 and the paper carrying direction B in which the recording paper 240 is carried in the paper eject section 206 is equal to or greater than 180°.

The recording paper 240 is supplied from the paper supply section 205 to the recording section 207, and subjected to a recording operation in the recording section 207, after which it passes between the roller 224 and the paper eject roller 226 and is laid on the paper eject tray 203 by virtue of gravity.

Herein, the recording paper 240 passing between the roller 224 and the paper eject roller 226 is carried in the paper carrying direction B while being cantilevered. Therefore, a leading edge portion of the recording paper 240 is subject to gravity and bent downward, whereby a trailing edge portion of the recording paper 240, which is on the platen 222, is subject to the upward restoring force C of the recording paper 240 itself. As a result, the trailing edge portion may be lifted up off the platen 222. Since the distance between the ink jet head 218 and the recording paper 240 is small, the recording quality may deteriorate.

In addition, as illustrated in FIG. 29B, an installation space 204 that is required for installing the printer 200 is significantly larger than the printer body 201. In an attempt to reduce the installation space, Japanese Laid-Open Patent Publication No. 11-334963 proposes a so-called "upright printer", including a thin, upright printer body 211 with a paper supply tray 212 and a paper eject tray 213 projecting out of the printer body 211 in a slanted upward direction, as illustrated in FIG. 31.

The paper supply tray 212 and the paper eject tray 213 are provided on the same side of the printer body 211. Moreover, the paper supply tray 212 and the paper eject tray 213 project from the printer body 211 in a slanted upward direction. Therefore, the center of gravity of the printer is shifted toward the side on which the trays 212 and 213 are provided. Thus, the printer is more likely to fall over. Moreover, even if the printer does not fall over, it creates a substantial vibration during the recording operation, whereby the recording operation is more likely to be unstable and the printing quality is more likely to deteriorate.

In the upright printer described above, the recording paper having undergone the printing operation is collected onto the paper eject tray 213 by virtue of gravity so as to smoothly collect paper onto the paper eject tray 213. Specifically, a paper eject roller 234 is provided at a position that is higher than the bottom portion of the paper eject tray 213 so that the trailing edge portion of the recording paper, which is fed forward by the paper eject roller 234, is allowed to fall down onto the paper eject tray 213 by virtue of gravity.

However, the degree of freedom in design is low due to the need to provide the paper eject roller 234 to be provided at a position that is higher than the bottom portion of the paper eject tray 213. Moreover, the paper eject tray 213 cannot be formed to extend in the vertical direction, but needs to be projecting from the printer body in a slanted upward direction. This presents a restraint on the reduction of the size of the recording apparatus.

Moreover, since the paper supply tray 212 and the paper eject tray 213 are projecting from the printer body 211 in a slanted upward direction, there is required an extra space by the amount by which the trays 212 and 213 are projecting. Thus, it is difficult to further reduce the installation space.

SUMMARY OF THE INVENTION

The present invention has been made in view of the above, and has an object to reduce the size of a recording apparatus.

Another object of the present invention is to prevent the apparatus from falling over, while improving the stability of the recording operation and the recording quality.

A recording apparatus of the present invention includes: a recording section for recording information on a recording medium; a medium carrying mechanism for carrying the recording medium on which information has been recorded by the recording section; a medium accommodating section extending in a vertical direction or in a slanted vertical direction for accommodating the recording medium carried by the medium carrying mechanism; and pusher means for pushing the recording medium carried by the medium carrying mechanism into the medium accommodating section.

In one embodiment: the medium accommodating section includes a wall surface that contacts a portion of the recording medium carried by the medium carrying mechanism; and the pusher means pushes the recording medium into the medium accommodating section after the recording medium contacts the wall surface.

In one embodiment: the medium carrying mechanism carries the recording medium in a horizontal direction or in a slanted horizontal direction; the medium accommodating section includes a wall surface that extends in a vertical direction or in a slanted vertical direction and contacts a leading edge portion of the recording medium fed forward by the medium carrying mechanism; and the pusher means pushes a trailing edge portion of the recording medium toward the wall surface so as to pivot an uncontacted portion of the recording medium about an axis, the axis being a trailing edge of a contacted portion of the recording medium that is in contact with the wall surface.

In one embodiment, the recording apparatus further includes a redirecting member for changing a medium carrying direction of the recording medium carried by the medium carrying mechanism, wherein: the recording section includes a non-contact recording head for recording information on the recording medium, and a platen opposing a head surface of the recording head; and a medium path angle is equal to or greater than 0° and less than 180°, the medium path angle being defined as an angle between the medium carrying direction of the recording medium while the recording medium is on the platen and that after a medium path is changed by the redirecting member.

In one embodiment, the recording head is an ink jet head.

In one embodiment, the redirecting member is a plate-shaped member that is provided on a downstream side in the medium carrying direction with respect to the platen, the plate-shaped member being inclined with respect to the medium carrying direction of the recording medium on the platen so that an upstream end and a downstream end of the plate-shaped member are on a platen side and on a recording head side, respectively, with respect to each other.

In one embodiment, the redirecting member is a non-flat plate that is provided on a downstream side in the medium carrying direction with respect to the platen.

In one embodiment, the redirecting member is a non-flat plate that is provided on a downstream side in the medium carrying direction with respect to the platen, the non-flat plate providing a medium path angle that changes gradually.

In one embodiment, the redirecting member includes a plate-shaped member that is provided on a downstream side in the medium carrying direction with respect to the platen, and a drive mechanism for pivoting the plate-shaped member to change the medium carrying direction after a leading edge portion of the recording medium has moved onto the plate-shaped member.

In one embodiment, the redirecting member includes a plate-shaped member that is provided on a downstream side in the medium carrying direction with respect to the platen, the plate-shaped member extending parallel to the medium carrying direction of the medium carrying mechanism, and a drive mechanism for pivoting the plate-shaped member to change the medium carrying direction after a leading edge portion of the recording medium has moved onto the plate-shaped member.

In one embodiment, the redirecting member is a non-flat plate that is provided on a downstream side in the medium carrying direction with respect to the platen, the non-flat plate including an introduction portion that is parallel to the medium carrying direction of the medium carrying mechanism and a redirecting portion that is located downstream of the introduction portion and provides a medium path angle equal to or greater than 0° and less than 180°.

In one embodiment, the medium path angle is equal to or greater than 110° and less than or equal to 130°.

In one embodiment, the medium carrying mechanism includes a medium carrying roller for carrying the recording medium from the platen to the redirecting member, and a counter roller opposing the medium carrying roller.

In one embodiment, the counter roller is provided on a downstream side in the medium carrying direction with respect to the platen, and is made up of a plurality of rollers arranged coaxially with one another.

In one embodiment: the medium accommodating section includes an introduction wall that is provided on a downstream side in the medium carrying direction with respect to the platen, the introduction wall being inclined with respect to the medium carrying direction of the recording medium on the platen so that an upstream end and a downstream end of the introduction wall are on a platen side and on a recording head side, respectively, with respect to each other, and the introduction wall functioning to define a portion of the medium accommodating section while introducing the recording medium into the medium accommodating section; and the redirecting member is the introduction wall.

In one embodiment, the recording apparatus further includes: an apparatus casing that extends in a vertical direction and includes a supply port and an eject port, each of which is opened in an upward direction or in a slanted upward direction; a supply-side medium accommodating section that extends in a vertical direction or in a slanted vertical direction and is continuous with the supply port for accommodating the recording medium supplied through the supply port; and a supply-side medium carrying mechanism for feeding forward the recording medium from the supply-side medium accommodating section and carrying the recording medium onto the platen, wherein: the medium accommodating section forms an eject-side medium accommodating section that extends in a vertical direction or in a slanted vertical direction and is continuous with the eject port; and the medium path extending from the supply-side medium accommodating section to the eject-side medium accommodating section via the platen is generally U-shaped.

In one embodiment, the recording apparatus further includes a supply-side medium accommodating section that extends in a vertical direction or in a slanted vertical direction for accommodating the recording medium before being supplied to the recording section, wherein: the medium accommodating section forms an eject-side medium accommodating section for accommodating the recording medium after information is recorded thereon; and the recording section is provided between the supply-side medium accommodating section and the eject-side medium accommodating section and includes a recording head that is provided at a height that is substantially equal to that of a bottom side of the supply-side medium accommodating section.

In one embodiment: the pusher means includes a moving member for pushing a trailing edge portion of the recording medium into the medium accommodating section by moving into the medium accommodating section.

In one embodiment: the medium accommodating section includes a restricting plate for supporting a side edge portion of the recording medium, the restricting plate being moved in a width direction of the recording medium according to a size of the recording medium; and the moving member is provided at a position that is lower than the restricting plate.

In one embodiment: the medium accommodating section includes a wall surface; and the moving member presses the trailing edge portion of the recording medium against the wall surface of the medium accommodating section, whereby the recording medium is accommodated in the medium accommodating section while being held between the moving member and the wall surface.

In one embodiment: the medium accommodating section includes a restricting plate for supporting a side edge portion of the recording medium, the restricting plate being moved in a width direction of the recording medium according to a size of the recording medium; and the moving member is a rod-shaped or plate-shaped member that extends in the width direction of the recording medium and includes a through hole for allowing the restricting plate to be passed therethrough while the moving member moves into the medium accommodating section.

In one embodiment: the medium accommodating section includes a restricting plate for supporting a side edge portion of the recording medium, the restricting plate being moved in a width direction of the recording medium according to a size of the recording medium; and the moving member is a plurality of rod-shaped or plate-shaped members that extend in the width direction of the recording medium and are formed according to the size of the recording medium.

In one embodiment, the recording apparatus further includes a supply section for supplying the recording medium, wherein the pusher means pushes the recording medium into the medium accommodating section from one side of the medium accommodating section that is closer to the supply section.

In one embodiment, the recording apparatus further includes a supply section for supplying the recording medium, wherein the pusher means pushes the recording medium into the medium accommodating section from one side of the medium accommodating section that is away from the supply section.

In one embodiment, the pusher means includes a pivoting member whose tip portion is located on an output side of the medium carrying mechanism, the pivoting member being pivoted so that the tip portion pushes a trailing edge portion of the recording medium, which has been fed forward by the medium carrying mechanism, into the medium accommodating section.

In one embodiment, the pivoting member functions also as a partition wall of the medium accommodating section.

In one embodiment: the medium accommodating section includes a restricting plate for supporting a side edge portion of the recording medium, the restricting plate being moved in a width direction of the recording medium according to a size of the recording medium; and the pivoting member includes a through hole for allowing the restricting plate to be passed therethrough while the pivoting member is pivoted.

In one embodiment: the medium accommodating section includes a restricting plate for supporting a side edge portion of the recording medium, the restricting plate being moved in a width direction of the recording medium according to a size of the recording medium; and the pivoting member is a plurality of plate-shaped members that are arranged in the width direction of the recording medium and are formed according to the size of the recording medium.

In one embodiment, the medium accommodating section accommodates the recording medium in an upright position.

In one embodiment, the recording apparatus further includes: an apparatus casing that extends in a vertical direction and includes a supply port and an eject port, each of which is opened in an upward direction or in a slanted upward direction; a supply-side medium accommodating section that extends in a vertical direction or in a slanted vertical direction and is continuous with the supply port for accommodating the recording medium supplied through the supply port; and a supply-side medium carrying mechanism for feeding forward and carrying the recording medium from the supply-side medium accommodating section, wherein: the recording section includes a platen holding the recording medium carried by the supply-side medium carrying mechanism and a recording head for recording information on the recording medium; the medium carrying mechanism forms an eject-side medium carrying mechanism; the medium accommodating section forms an eject-side medium accommodating section that extends in a vertical direction or in a slanted vertical direction and is continuous with the eject port; the recording section is located on an opposite side of the apparatus casing with respect to the supply port and the eject port and is spaced apart from the supply port and the eject port by a distance equal to or greater than one half of a longitudinal dimension of the apparatus casing; and one or both of the supply-side medium accommodating section and the eject-side medium accommodating section is or are provided with an open/close lid.

In one embodiment, the recording apparatus further includes: an apparatus casing that extends in a vertical direction and includes a supply port and an eject port, each of which is opened in an upward direction or in a slanted upward direction; a supply-side medium accommodating section that extends in a vertical direction or in a slanted vertical direction and is continuous with the supply port for accommodating the recording medium supplied through the supply port; and a supply-side medium carrying mechanism for feeding forward and carrying the recording medium from the supply-side medium accommodating section, wherein: the recording section includes a platen holding the recording medium carried by the supply-side medium carrying mechanism and a recording head for recording information on the recording medium; the medium carrying mechanism forms an eject-side medium carrying mechanism; the medium accommodating section forms an eject-side medium accommodating section that extends in a vertical direction or in a slanted vertical direction and is continuous with the eject port; and the recording section is provided between the supply-side medium accommodating section and the eject-side medium accommodating section with respect to a direction perpendicular to a longitudinal direction of the apparatus casing.

In one embodiment, the recording apparatus further includes: an apparatus casing that extends in a vertical direction and includes a supply port and an eject port, each of which is opened in an upward direction or in a slanted upward direction; a supply-side medium accommodating section that extends in a vertical direction or in a slanted vertical direction and is continuous with the supply port for accommodating the recording medium supplied through the supply port; and a supply-side medium carrying mechanism for feeding forward and carrying the recording medium from the supply-side medium accommodating section, wherein: the recording section includes a platen holding the recording medium carried by the supply-side medium carrying mechanism and a recording head for recording information on the recording medium; the medium carrying mechanism forms an eject-side medium carrying mechanism; the medium accommodating section forms an eject-side medium accommodating section that extends in a vertical direction or in a slanted vertical direction and is continuous with the eject port; and an upper surface of the apparatus casing is defined by a flat upper plate, and the upper plate, an upper surface of the supply-side medium accommodating section and an upper surface of the eject-side medium accommodating section are formed to be substantially flush with one another.

In one embodiment, the recording apparatus further includes: an apparatus casing that extends in a vertical direction and includes a supply port and an eject port, each of which is opened in an upward direction or in a slanted upward direction; a supply-side medium accommodating section that extends in a vertical direction or in a slanted vertical direction and is continuous with the supply port for accommodating the recording medium supplied through the supply port; and a supply-side medium carrying mechanism for feeding forward and carrying the recording medium from the supply-side medium accommodating section, wherein: the recording section includes a recording head for recording information on the recording medium carried by the supply-side medium carrying mechanism; the medium carrying mechanism forms an eject-side medium carrying mechanism for carrying the recording medium on which information has been recorded by the recording head; the medium accommodating section forms an eject-side medium accommodating section that extends in a vertical direction or in a slanted vertical direction and is continuous with the eject port; and the medium path extending from the supply-side medium accommodating section to the eject-side medium accommodating section via the recording section is generally U-shaped.

In one embodiment: each of the supply-side medium accommodating section and the eject-side medium accommodating section includes a first side wall extending in a vertical direction or in a slanted vertical direction, a second side wall opposing the first side wall with a predetermined interval therebetween and extending in a vertical direction or in a slanted vertical direction, and a bottom wall extending from one of the first side wall and the second side wall toward the other one of the first side wall and the second side wall; and the bottom wall of the eject-side medium accommodating section is provided at a position that is lower than a head surface of the recording head.

In one embodiment: each of the supply-side medium accommodating section and the eject-side medium accommodating section includes a first side wall extending in a vertical direction or in a slanted vertical direction, a second side wall opposing the first side wall with a predetermined interval therebetween and extending in a vertical direction or in a slanted vertical direction, and a bottom wall extending from one of the first side wall and the second side wall toward the other one of the first side wall and the second side wall; and the bottom wall of the eject-side medium accommodating section is inclined so that one end thereof that is closer to the recording head is lower than the other end.

In one embodiment: each of the supply-side medium accommodating section and the eject-side medium accommodating section includes a first side wall extending in a vertical direction or in a slanted vertical direction, a second side wall opposing the first side wall with a predetermined interval therebetween and extending in a vertical direction or in a slanted vertical direction, and a bottom wall extending from one of the first side wall and the second side wall toward the other one of the first side wall and the second side wall; and the bottom wall of the eject-side medium accommodating section is inclined so that one end thereof that is closer to the recording head is higher than the other end.

In one embodiment: the recording head is provided between the supply-side medium accommodating section and the eject-side medium accommodating section with respect to a direction perpendicular to a longitudinal direction of the apparatus casing; the apparatus casing is configured so that the recording apparatus can be placed in a horizontal position so that the supply port and the eject port are opened in a horizontal direction or in a slanted horizontal direction; the supply-side medium carrying mechanism feeds forward the recording medium from the supply-side medium accommodating section from one side of the supply-side medium accommodating section that is closer to the recording head; and the eject-side medium carrying mechanism introduces the recording medium on which information has been recorded into the eject-side medium accommodating section from one side of the eject-side medium accommodating section that is away from the recording head.

In one embodiment: the supply-side medium carrying mechanism includes a pickup roller for taking out the recording medium from the supply-side medium accommodating section, a drive roller for feeding forward the recording medium taken out by the pickup roller toward the recording head, and a pinch roller for nipping the recording medium between the pinch roller and the drive roller; and vertically projected images of the pickup roller, the drive roller and the pinch roller overlap with one another.

In one embodiment, the recording apparatus further includes a lid for opening/closing the supply port.

In one embodiment, the recording apparatus further includes a lid for opening/closing the eject port.

In one embodiment, the apparatus casing is configured so that the recording apparatus can be placed in a horizontal position so that the supply port and the eject port are opened in a horizontal direction or in a slanted horizontal direction.

Another recording apparatus of the present invention includes: an apparatus casing including at least an eject port that is opened in an upward direction or in a slanted upward direction; a recording section provided in the apparatus casing for recording information on a recording medium; a medium carrying mechanism provided in the apparatus casing for carrying the recording medium on which information has been recorded by the recording section; a medium accommodating section extending in a vertical direction or in a slanted vertical direction in the apparatus casing and defining a medium accommodating space that is continuous with the eject port for accommodating the recording medium carried by the medium carrying mechanism so that the recording medium is surrounded by the medium accommodating section and is held in an upright position; and an upward medium carrying mechanism provided in the medium accommodating section for upwardly carrying the recording medium so as to eject a part or whole of the recording medium from the eject port.

In one embodiment, the recording apparatus further includes a size detector for detecting a size of the recording medium in the medium accommodating section, wherein the upward medium carrying mechanism carries the recording medium upward by an amount according to the size of the recording medium detected by the size detector so that the recording medium projects from the eject port by a predetermined constant length.

In one embodiment, the recording apparatus further includes: an input device through which a size of the recording medium is input; and a size memory device for storing the size of the recording medium input through the input device, wherein the upward medium carrying mechanism carries the recording medium upward by an amount according to the size of the recording medium stored in the size memory device so that the recording medium projects from the eject port by a predetermined constant length.

In one embodiment, the upward medium carrying mechanism includes a support plate for supporting a lower edge portion of the recording medium and a drive mechanism for moving the support plate up and down.

In one embodiment: the medium accommodating section includes a side plate for supporting a side edge portion of the recording medium, the side plate being set to a predetermined position according to a size of the recording medium by being moved in a width direction of the recording medium; and the upward medium carrying mechanism includes a divided plate that is divided into a plurality of plates at each predetermined position of the side plate for supporting a lower edge portion of the recording medium, and a drive mechanism for moving the divided plate up and down.

In one embodiment: the medium accommodating section includes a side plate for supporting a side edge portion of the recording medium, the side plate being set to a predetermined position according to a size of the recording medium by being moved in a width direction of the recording medium; and the upward medium carrying mechanism includes a support plate for supporting a lower edge portion of the recording medium, the support plate including a through hole at a position corresponding to each predetermined position of the side plate for allowing the side plate to be passed therethrough, and a drive mechanism for moving the support plate up and down.

In one embodiment, the recording apparatus further includes: a size detector for detecting the size of the recording medium in the medium accommodating section; and a protective device for determining whether or not the position of the side plate corresponds to the size of the recording medium detected by the size detector, and for stopping an operation of the upward medium carrying mechanism when the position of the side plate does not correspond to the size of the recording medium.

In one embodiment, the recording apparatus further includes: an input device through which the size of the recording medium is input; a size memory device for storing the size of the recording medium input through the input device; and a protective device for determining whether or not the position of the side plate corresponds to the size of the recording medium stored in the size memory device, and for stopping an operation of the upward medium carrying mechanism when the position of the side plate does not correspond to the size of the recording medium.

In one embodiment, the recording apparatus further includes: a size detector for detecting the size of the recording medium in the medium accommodating section; and an alarm device for determining whether or not the position of the side plate corresponds to the size of the recording medium detected by the size detector, and for giving a warning when the position of the side plate does not correspond to the size of the recording medium.

In one embodiment, the recording apparatus further includes: an input device through which the size of the recording medium is input; a size memory device for storing the size of the recording medium input through the input device; and an alarm device for determining whether or not the position of the side plate corresponds to the size of the recording medium stored in the size memory device, and for giving a warning when the position of the side plate does not correspond to the size of the recording medium.

In one embodiment, the recording apparatus further includes an eject switch to which an eject instruction signal is input via wire or wireless, wherein the upward medium carrying mechanism starts a medium carrying operation when the eject switch is turned ON.

In one embodiment, the recording apparatus further includes an indication device for giving a predetermined indication when the recording medium has been carried into and is accommodated in the medium accommodating section.

In one embodiment, the recording apparatus further includes an open/close lid for opening/closing the eject port.

In one embodiment, the recording section includes a non-contact recording head.

In one embodiment, the recording head is an ink jet head.

DESCRIPTION OF THE PREFERRED EMBODIMENTS

Embodiments of the present invention will now be described with reference to the drawings.

Embodiment 1

Figure 1:
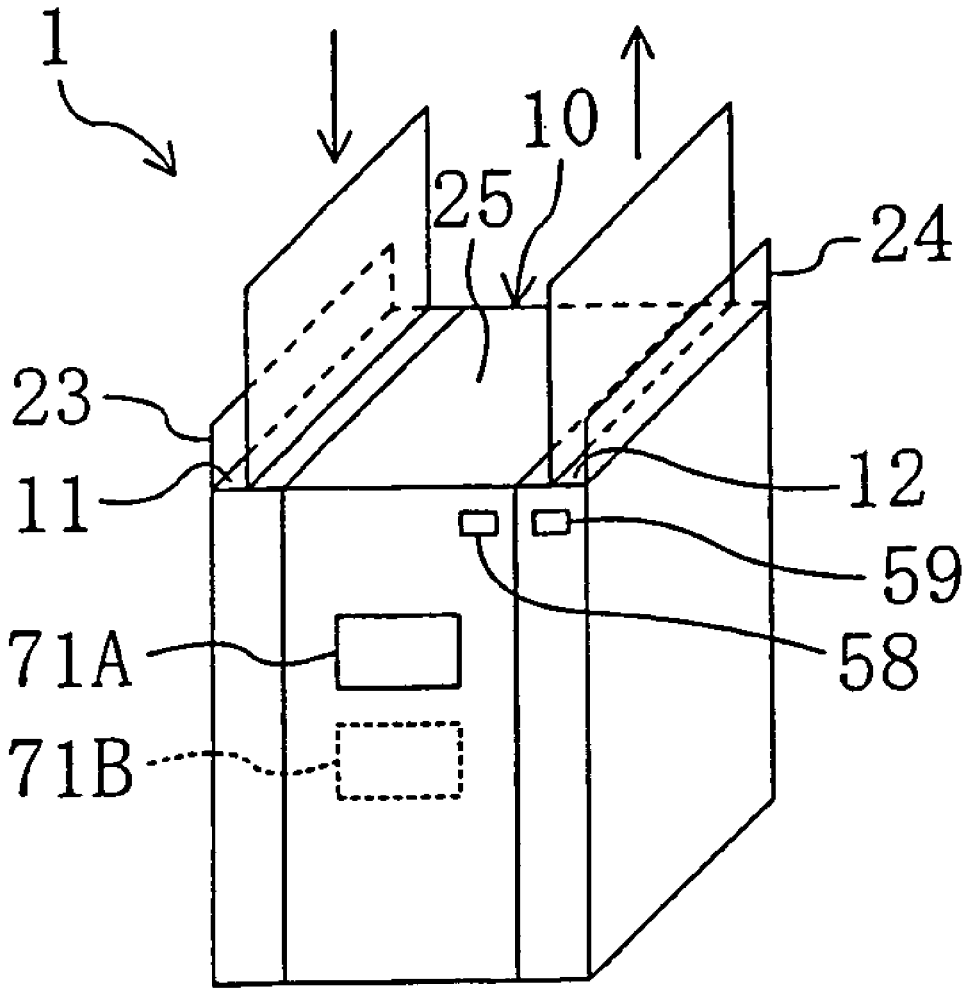
FIG. 1 is a perspective view illustrating a printer in an upright position.
Figure 2:
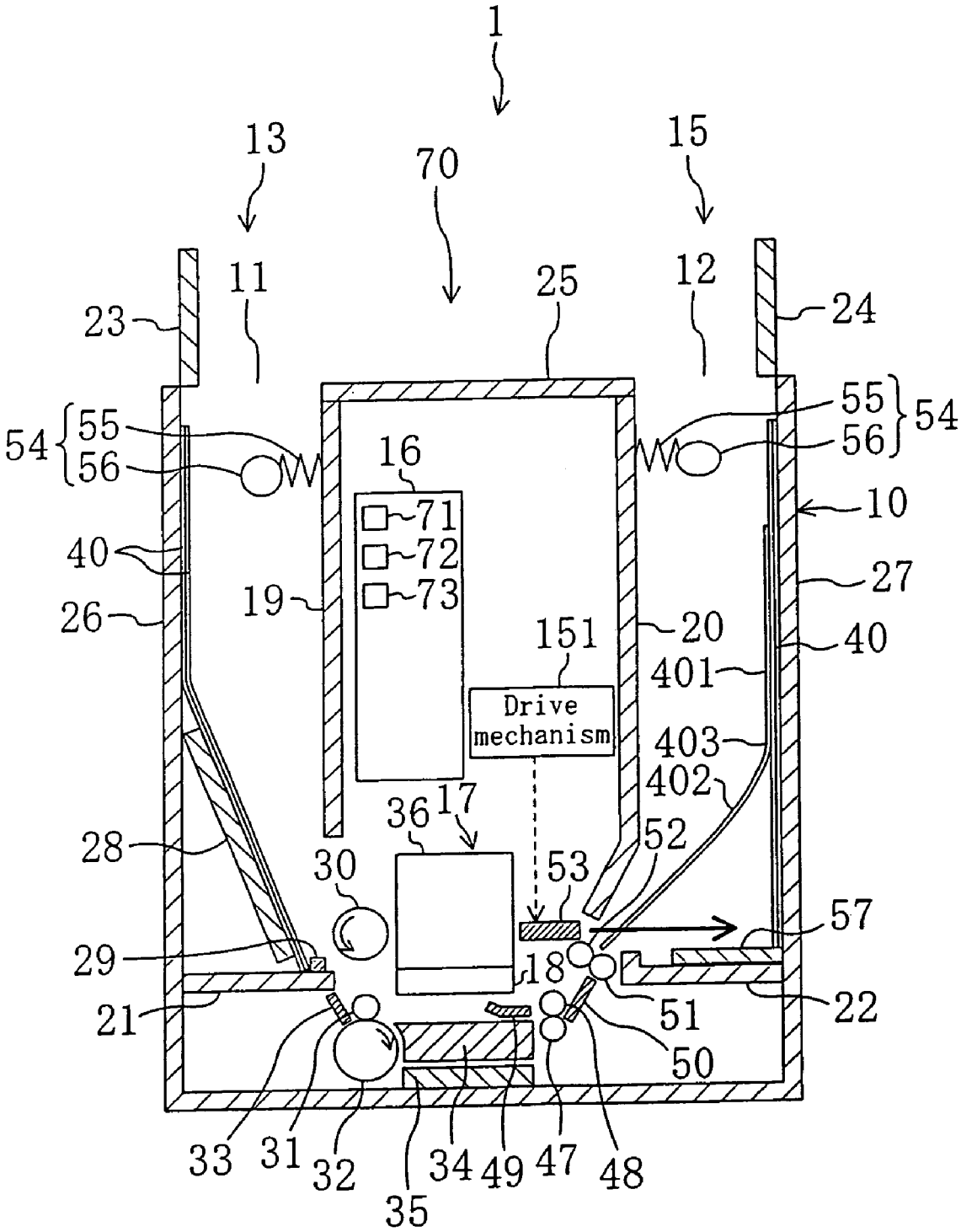
FIG. 2 is a cross-sectional view illustrating a printer.

As illustrated in FIG. 1 and FIG. 2, the recording apparatus of Embodiment 1 is an ink jet printer 1 that can be placed in an upright position. Although the printer 1 can be placed in a horizontal position, a case where the printer 1 is placed in an upright position will be described below.

The printer 1 includes a casing 10 in an upright rectangular parallelepiped shape. A paper supply port 11 is provided in a left-side portion of a top plate 25 of the casing 10, and a paper eject port 12 is provided in a right-side portion of the top plate 25. The paper supply port 11 and the paper eject port 12 are each an opening that is facing upward and has a shape elongated in the front-back direction. Lids 23 and 24 are provided for the paper supply port 11 and the paper eject port 12, respectively.

As illustrated in FIG. 2, the casing 10 includes two partition plates 19 and 20 extending downward from the top plate 25, a partition plate 21 extending rightward from a left-side plate 26 in a lower portion of the casing 10, and a partition plate 22 extending leftward from a right-side plate 27 in a lower portion of the casing 10. The inside of the casing 10 is partitioned by these partition plates 19, 20, 21 and 22. A paper supply section 13, a control section 16, a recording section 17 and a paper eject section 15 are formed in the casing 10. Specifically, the paper supply section 13 is formed in a left-side portion of the casing 10 by being defined by the left-side plate 26, the partition plate 19 and the partition plate 21. The paper eject section 15 is formed in a right-side portion of the casing 10 by being defined by the right-side plate 27, the partition plate 20 and the partition plate 22. The recording section 17 including an ink jet head 18 is formed in a lower central portion of the casing 10. The control section 16 is formed above the recording section 17 by being defined by the partition plate 19 and the partition plate 20. Note that the control section 16 and the recording section 17 together form a main body section 70.

The left-side plate 26, the partition plate 19 and the partition plate 21 of the paper supply section 13 define a supply-side paper accommodating section for accommodating recording paper 40 before the printing operation. The partition plate 19 is provided with a paper holding mechanism 54 for preventing the recording paper 40 from being falling over. The paper holding mechanism 54 includes a spring 55 attached to the partition plate 19, and a roller 56 attached to the tip of the spring 55. The paper holding mechanism 54 presses an upper edge portion of the recording paper 40 against the left-side plate 26 by the spring force of the spring 55 so as to prevent the recording paper 40 from falling over, while allowing the recording paper 40 to be carried smoothly by the rotation of the roller 56.

The paper supply section 13 includes an inclined plate 28 leaning against the left-side plate 26 over the partition plate 21, and a retractable protrusion 29 provided on the partition plate 21 near the tip thereof (on the right side in FIG. 2). A pickup roller 30 is provided at a position opposing the lower end portion of the inclined plate 28. The inclined plate 28, the protrusion 29 and the pickup roller 30 together form a paper feed mechanism for feeding forward the recording paper 40 in the paper supply section 13 sheet by sheet into the recording section 17. When feeding forward the recording paper 40, the protrusion 29 retracts down into the partition plate 21 and the inclined plate 28 is moved to a greater inclination so that the lower edge portion of the recording paper 40 on the inclined plate 28 is brought into contact with the pickup roller 30. Then, as the pickup roller 30 rotates, only one sheet of the recording paper 40 that is at the top of the stack on the inclined plate 28 is fed forward to the recording section 17.

A pinch roller (multi-piece roller) 31 including a plurality of small rollers arranged in the front-back direction (the direction vertical to the sheet of FIG. 2) and a paper supply roller 32, which is a drive roller opposing the pinch roller 31, are provided under the pickup roller 30. The pickup roller 30, the pinch roller 31 and the paper supply roller 32 are aligned in the vertical direction. Therefore, the pickup roller 30 and the paper supply roller 32 overlap with each other in the vertical direction. Vertically projected images of the pickup roller 30, the paper supply roller 32 and the pinch roller 31 overlap with one another. A guide plate 33 is provided on the left side of the pinch roller 31 so as to extend from the paper supply section 13 toward the recording section 17. The guide plate 33 is provided for guiding the leading edge portion of the recording paper 40 carried from the paper supply section 13 to the position between the paper supply roller 32 and the pinch roller 31. Note that the pickup roller 30, the pinch roller 31 and the paper supply roller 32 together form a supply-side paper carrying mechanism.

Figure 3:
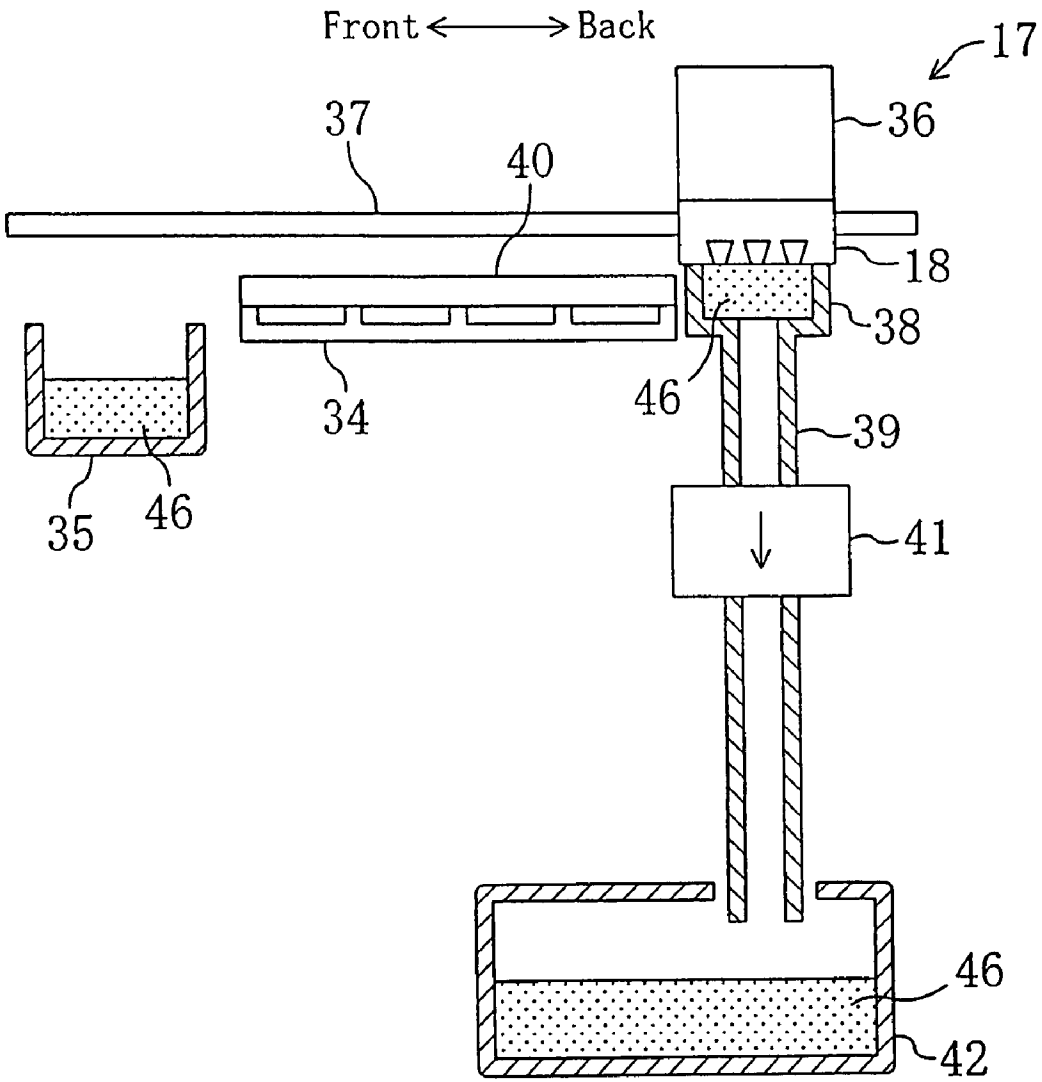
FIG. 3 is a diagram illustrating the configuration of an important part of a recording section.

As illustrated in FIG. 3 (note that the details of the recording section 17 are omitted in FIG. 2), the recording section 17 includes the ink jet head 18 as a recording head, and an ink tank 36 for supplying ink to the ink jet head 18. The ink jet head 18 of the present embodiment is a piezo-type ink jet head. Note however that the recording head may alternatively be any other suitable head such as a bubble-type ink jet head. The ink tank 36 is integrally attached to the ink jet head 18. The ink jet head 18 and the ink tank 36 are reciprocally attached to a carriage shaft 37 extending in the front-back direction (the left-right direction in FIG. 3). A platen 34 is provided under the carriage shaft 37 so as to oppose the head surface of the ink jet head 18.

Figure 4A:
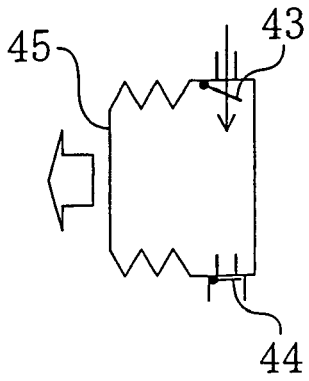
FIG. 4A and FIG. 4B are cross-sectional views each illustrating an ink suction mechanism.
Figure 4B:
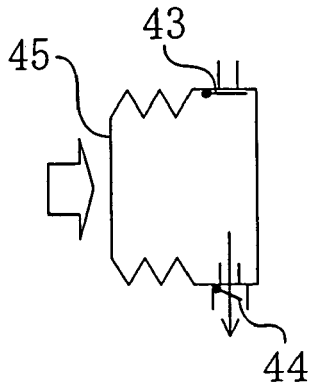

A cap 38 is provided on the back side of the platen 34 for covering the head surface of the ink jet head 18 while the ink jet head 18 is in a non-recording position. An ink discharge tube 39 is attached to the cap 38, and the tube 39 is provided with an ink suction mechanism 41. The ink suction mechanism 41 sucks ink from the ink jet head 18 into the cap 38 and discharges the ink from the cap 38 into an ink container 42 via the tube 39. While the ink suction mechanism 41 is not limited to any particular mechanism, the ink suction mechanism 41 may be, for example, a pump including a bellows-shaped member 45 provided with an inlet valve 43 and an outlet valve 44, as illustrated in FIG. 4A and FIG. 4B.

The ink jet head 18 intermittently discharges ink through all nozzles while in the non-recording position so as to prevent the viscosity of ink in the nozzles from increasing. As illustrated in FIG. 3, an ink container 35 is provided on the front side of the platen 34 for collecting such discharged ink. Note that an ink absorber 46 made of a sponge, or the like, is provided in the cap 38, the ink container 42 and the ink container 35 primarily for preventing ink from being scattered around. It is preferred that the ink container 42 is sealed except for an opening into which the tube 39 is inserted so that ink will not leak from the ink container 42 when the printer 1 is placed in a horizontal position.

As illustrated in FIG. 2, a paper eject roller 47, which is a drive roller, and a spur roller 48 opposing the paper eject roller 47 are provided on the right side of the platen 34. The paper eject roller 47 is made of a single round bar extending in the front-back direction. The side surface of the paper eject roller 47 is covered with a rubber. On the other hand, the spur roller 48 includes a plurality of small rollers arranged at regular intervals in the front-back direction. The spur roller 48 presses the recording paper 40 at positions that are arranged at regular intervals so as to give the recording paper 40 an appropriate tension, thereby preventing a jam from occurring.

In an ink jet recording operation, ink dots are formed by ink droplets landing on the recording paper 40. When the ink droplets land on the recording paper 40, the solvent contained in the ink evaporates immediately. Then, the recording paper 40 contracts, and a crease or corrugation may occur in the recording paper 40, thereby changing the interval between the ink jet head 18 and the recording paper 40 and thus deteriorating the recording quality. In view of this, according to the present embodiment, the spur roller 48 is used as a counter roller for the paper eject roller 47 so as to give a certain tension to the recording paper 40, thereby making the recording paper 40 flat on the platen 34. Moreover, since the spur roller 48 is in direct contact with the recording surface immediately after ink dots are formed thereon, it is preferred that the spur roller 48 contacts in a small contact area with the recording surface. In view of this, the spur roller 48 of the printer 1 is a multi-piece spur roller including a plurality of small rollers.

A guide plate 49 is provided above a right edge portion of the platen 34 for guiding the recording paper 40 to the position between the paper eject roller 47 and the spur roller 48. The guide plate 49 is a plate-shaped member extending in a horizontal direction, with a left edge portion thereof being bent upward so as to facilitate the introduction of the recording paper 40 thereto.

A redirecting plate 50 is provided on the right side of the paper eject roller 47 and the spur roller 48 for changing the paper path of the recording paper 40 to an upper right direction toward the paper eject section 15. The material of the redirecting plate 50 is not limited to any particular material and may be, for example, a metal, a plastic, etc. Moreover, while the redirecting plate 50 is a flat plate in the present embodiment, it may alternatively be a non-flat plate, or the like. The term "non-flat plate" as used herein includes bent plates and curved plates.

A drive roller 51 and a counter roller 52 are provided on the upper right side of the redirecting plate 50. A pusher member 53, movable in the left-right direction, is provided above the drive roller 51 and the counter roller 52. The pusher member 53 pushes a trailing edge portion (an about ⅓ portion from the trailing edge) of the recording paper 40 carried by the drive roller 51 and the counter roller 52 into the paper eject section 15. In the present embodiment, the pusher member 53 pivots an uncontacted portion 402 of the recording paper 40 about an axis 403, the axis 403 being the trailing edge of a contacted portion 401 of the recording paper 40 that is in contact with the right-side plate 27. While the pusher member 53 is a flat plate in the present embodiment, the pusher member 53 is not limited to any particular shape, and may alternatively be in a columnar shape, a prism shape, etc. The pusher member 53 is provided with a drive mechanism 151. Note that the paper eject roller 47, the spur roller 48, the redirecting plate 50, the drive roller 51 and the counter roller 52 together form a eject-side paper carrying mechanism.

The right-side plate 27, the partition plate 20 and the partition plate 22 of the paper eject section 15 together form an eject-side paper accommodating section for accommodating the recording paper 40 after the recording operation. As in the paper supply section 13, the partition plate 20 of the paper eject section 15 is also provided with the paper holding mechanism 54 including the spring 55 and the roller 56. A tip portion of the partition plate 22 is bent upward so as to prevent the recording paper 40 from falling down.

The inner surface of the right-side plate 27 provides a wall surface to which a leading edge portion of the recording paper 40 being carried contacts. When the leading edge portion of the recording paper 40 contacts the inner surface of the right-side plate 27, the paper path thereof is changed to an upward direction. The recording paper 40 is carried into the paper eject section 15 while being in contact with the right-side plate 27.

Figure 5:
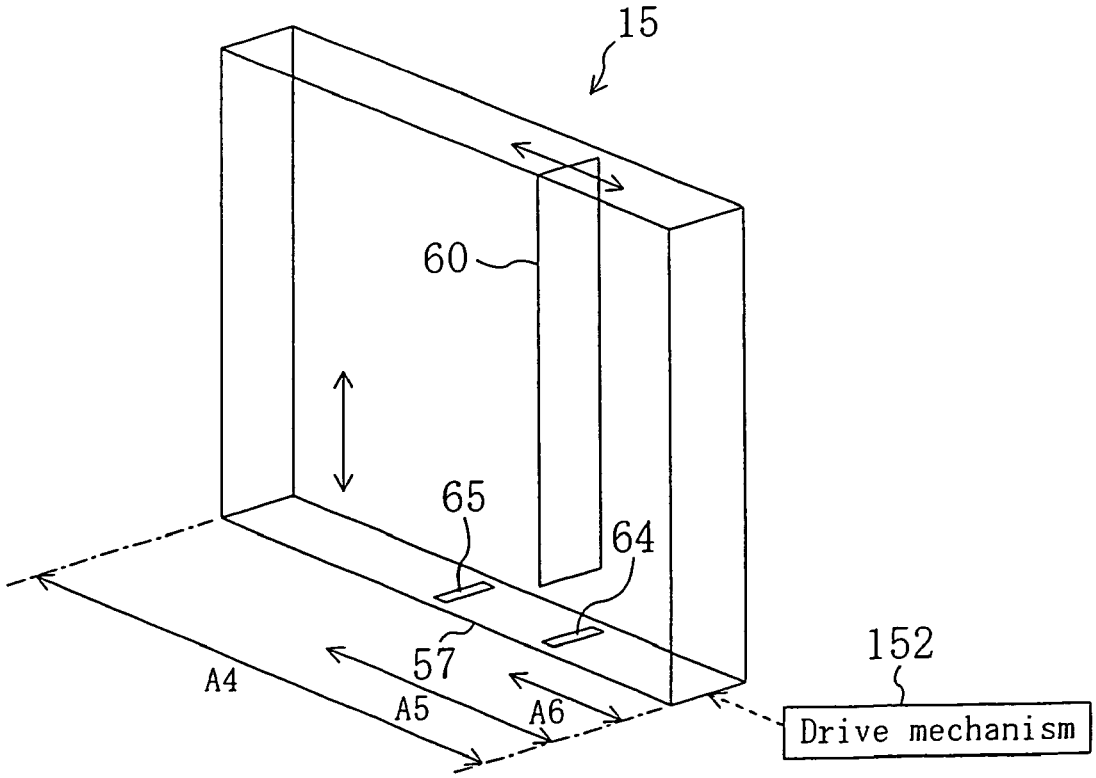
FIG. 5 is a perspective view illustrating an important part of a paper eject section.

Moreover, the paper eject section 15 is provided with a moving plate 57, as an upward paper carrying mechanism, that is moved up and down by a drive mechanism 152 (see FIG. 5). The moving plate 57 is made of a metal or a plastic, and may have any of various shapes such as a plate shape, a rod shape or a mesh shape. In the present embodiment, the moving plate 57 is formed in a flat plate shape. The upper surface of the moving plate 57 is a smooth surface that forms a support surface for supporting the trailing edge portion of the recording paper 40. The moving plate 57 is positioned in a bottom portion of the paper eject section 15 (i.e., on the upper surface of the partition plate 22) during a recording operation, and is moved up when the recording paper 40 is taken out from the paper eject port 12. As the moving plate 57 is moved up, the recording paper 40 projects from the paper eject port 12 by a predetermined length. Thus, the user can easily take out the recording paper 40 by picking up an upper edge portion of the recording paper 40, without having to put a hand into the paper eject section 15.

The moving plate 57 is not limited to any particular material as long as the moving plate 57 is capable of lifting up the trailing edge portion of the recording paper 40. For example, a metal, a plastic, a ceramics, or a composite material thereof may be used. Moreover, the moving plate 57 is not limited to any particular shape. For example, the shape of the moving plate 57 may be a plate shape, a rod shape, a rectangular shape, a circular shape, a triangular shape, a polygonal shape, etc.

As illustrated in FIG. 5, the paper eject section 15 is provided with a paper partition 60 for supporting a side edge portion of the recording paper 40. The paper partition 60 is a flat plate that can be moved in the front-back direction (i.e., the width direction of the recording paper 40) either manually or automatically according to the size of the recording paper 40.

Figure 6A:
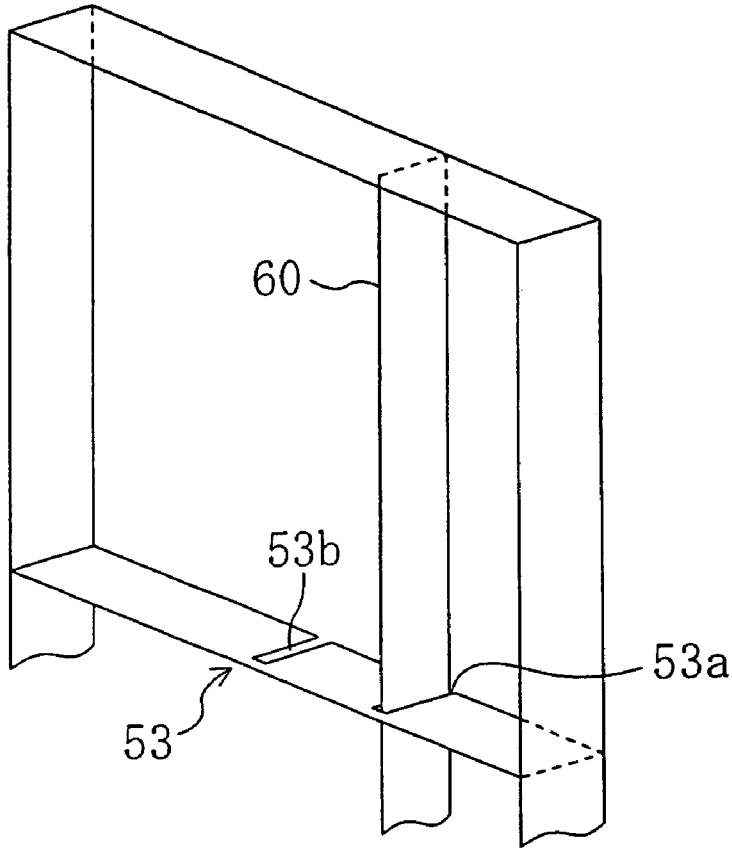
FIG. 6A is a perspective view illustrating an important part of a paper eject section.

As illustrated in FIG. 6A, the pusher member 53 includes a first slit 53*a* and a second slit 53*b*, through which the paper partition 60 can be passed when the pusher member 53 is moved. The first slit 53*a* is provided at a position at which the paper partition 60 is placed when the recording paper 40 is A6-size paper. The second slit 53*b* is provided at a position at which the paper partition 60 is placed when the recording paper 40 is A5-size paper. The provision of the slits 53*a* and 53*b* prevents the pusher member 53 and the paper partition 60 from colliding with each other, and ensures a smooth operation of the pusher member 53.

Figure 6B:
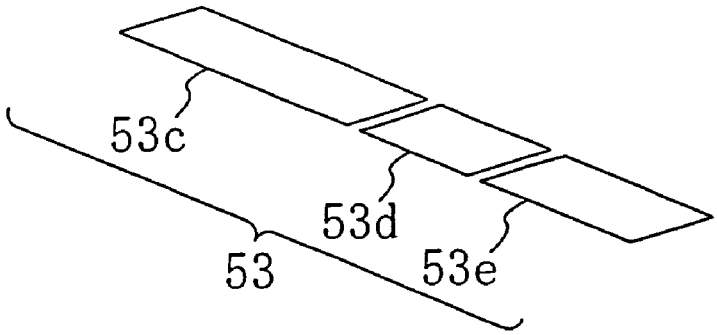
FIG. 6B is a perspective view illustrating a pusher member.

Note that the pusher member 53 may alternatively be divided into a plurality of members 53*c*, 53*d* and 53*e*, as illustrated in FIG. 6B, so as to prevent the pusher member 53 and the paper partition 60 from colliding with each other.

The moving plate 57 includes a first through hole 64 and a second through hole 65, through which the paper partition 60 can be passed when the moving plate 57 is moved up and down. The first through hole 64 is provided at a position at which the paper partition 60 is placed when the recording paper 40 is A6-size paper. The second through hole 65 is provided at a position at which the paper partition 60 is placed when the recording paper 40 is A5-size paper. The provision of the through holes 64 and 65 prevents the moving plate 57 and the paper partition 60 from colliding with each other when taking out the recording paper 40, and ensures a smooth vertical movement of the moving plate 57.

Note that the control section 16 is provided with a paper size detector 71 for detecting the size of the recording paper 40 accommodated in the paper supply section 13, and an alarm mechanism 72 for determining whether or not the paper partition 60 is positioned according to the detected size of the recording paper 40 and for giving a warning when the paper partition 60 is not positioned accordingly. The size of the recording paper 40 may be automatically detected by the paper size detector 71, or may alternatively be manually input by the user to the paper size detector 71. For example, the paper size detector 71 may include an input section 71A (see FIG. 1) for allowing the user to input the size of the recording paper 40, and a storage section 71B for storing the size of the recording paper 40 having been input through the input section 71A. Moreover, the size of the recording paper 40 may be input remotely, e.g., by using a personal computer, a remote control, or the like.

The alarm mechanism 72 may be any of various appropriate mechanisms, such as a mechanism that gives an audible warning or a mechanism that gives a visual warning on the display unit (not shown) of the printer 1. Moreover, in order to prevent the printer 1 from being damaged, the alarm mechanism 72 may further include a protective device 73 for determining whether or not the paper partition 60 is positioned according to the size of the recording paper 40 and for forcibly stopping the movement of the moving plate 57 when the paper partition 60 is not positioned accordingly.

Figures 7A, 7B, 7C:
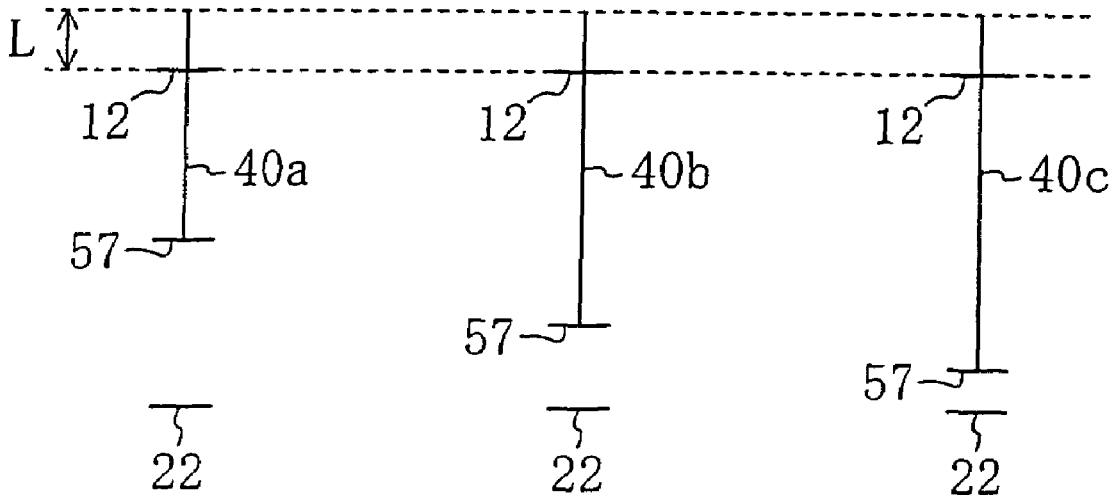
FIG. 7A to FIG. 7C are conceptual diagrams each illustrating a position to which a support plate is moved up according to a paper size.

As illustrated in FIG. 7A to FIG. 7C, the moving plate 57 is moved up to one of different positions according to the size of the recording paper 40 so that the recording paper 40 projects from the paper eject port 12 by a constant length L. Thus, the moving plate 57 is moved up to a higher position as the paper size is smaller. For example, as illustrated in FIG. 7A, when recording paper 40*a* is A6-size paper, the moving plate 57 is moved up to the first, highest position. As illustrated in FIG. 7B, when recording paper 40*b* is A5-size paper, the moving plate 57 is moved up to the second position that is lower than the first position. As illustrated in FIG. 7C, when recording paper 40*c* is A4-size paper, the moving plate 57 is moved up to the third, lowest position. Thus, with the recording paper 40*a* to 40*c* of different sizes, the recording paper 40*a* to 40*c* project from the paper eject port 12 by the same length L, thereby facilitating the operation of taking out the recording paper 40*a* to 40*c*. Moreover, even when taking out the large recording paper 40*c*, only a small space is required above the printer 1. In this way, it is possible to reduce the installation space.

As illustrated in FIG. 1, an eject switch 58 and an eject completion indicator 59 are provided on the front side of the casing 10. The eject switch 58 is turned ON by the user for taking out the recording paper 40 from the paper eject section 15. When the eject switch 58 is turned ON, the lid 24 of the paper eject section 15 is opened and the moving plate 57 is moved up, whereby a part of the recording paper 40 projects from the paper eject port 12. Then, the user can easily take out the recording paper 40. The eject switch 58 may be a known type of switch such as a push button, or any other appropriate type of switch, e.g., a switch remotely operated with a remote control, etc. The eject completion indicator 59 is an indicator for notifying the user of the presence/absence of the recording paper 40 in the paper eject section 15. The eject completion indicator 59 is lit when the recording paper 40 has been carried into, and is left in, the paper eject section 15, and is turned OFF after the recording paper 40 is taken out. Note however that the manner in which the eject completion indicator 59 gives the indication is not limited to this. Alternatively, the eject completion indicator 59 may be lit when the recording paper 40 has been taken out. Moreover, the eject completion indicator 59 may be either an independent indicator or incorporated in the display unit (not shown) that is used for viewing and changing various settings of the printer 1.

As described above, in the printer 1 of the present embodiment, the paper supply section 13 and the paper eject section 15 extend upward, with the main body section 70 being provided between the paper supply section 13 and the paper eject section 15 (see FIG. 2). Moreover, the paper path from the paper supply section 13 to the recording section 17, and the paper path from the recording section 17 to the paper eject section 15, are each formed so that the paper carrying direction in which the recording paper 40 is carried is changed by about 90°. The entire paper path extending from the paper supply section 13 to the paper eject section 15 is generally U-shaped.

Figure 8:
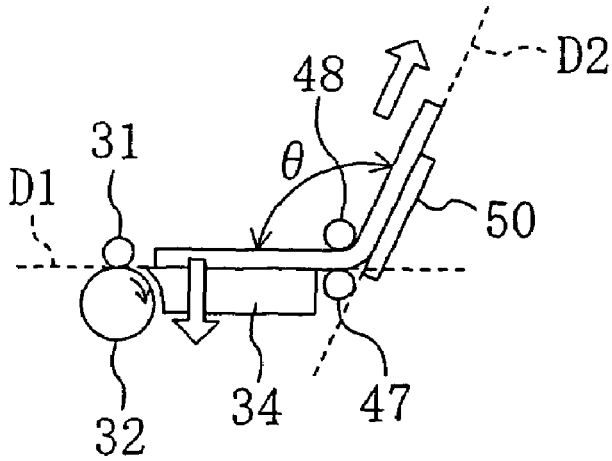
FIG. 8 is a side view illustrating a part around a recording section.
Figure 9A:
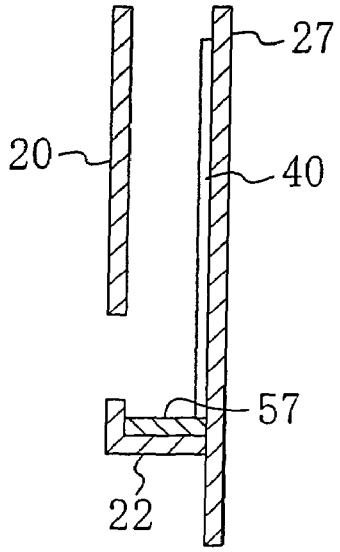
FIG. 9A to FIG. 9E are cross-sectional views each illustrating a paper eject section.
Figure 9B:
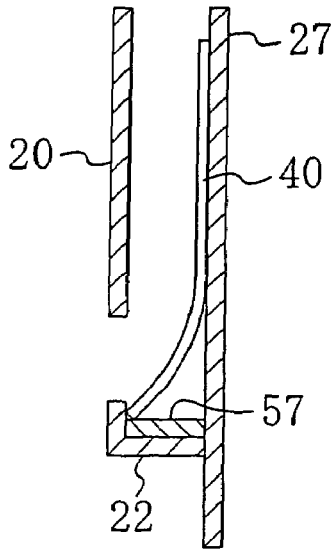
Figure 9C:
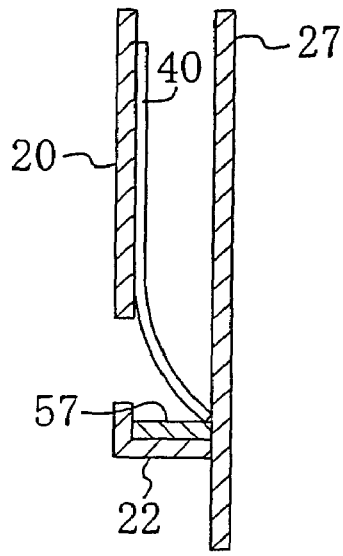
Figure 9D:
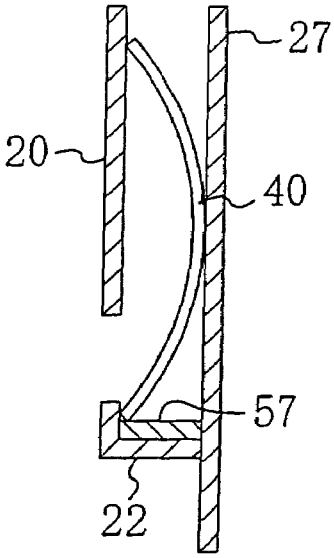
Figure 9E:
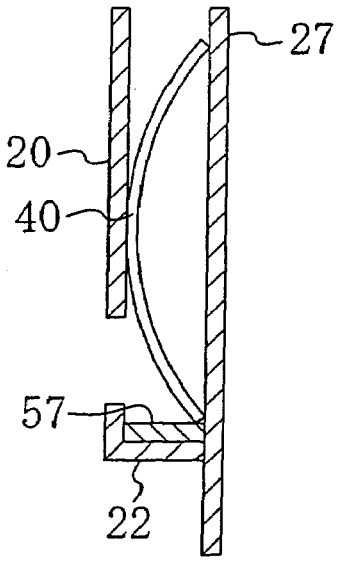

As illustrated in FIG. 8, the paper path angle θ of the paper path from the recording section 17 to the paper eject section 15, i.e., the angle θ between the paper carrying direction D1 in the recording section 17 and the paper carrying direction D2 toward the paper eject section 15, is equal to or greater than 0° and less than 180°. Note that the angle θ is preferably 90° to 150°, and more preferably 110° to 130°. In the present embodiment, the angle θ is set to be about 120°. The angle θ is set to be in the range of 0° to 180° so that the recording paper 40 is pressed against the platen 34 by virtue of the restoring force of the recording paper 40 itself, thereby making the recording surface flat.

As illustrated in FIG. 1 and FIG. 2, the paper supply port 11 of the paper supply section 13 and the paper eject port 12 of the paper eject section 15 are provided at the same height as the top plate 25. Moreover, with the lids 23 and 24 being closed, the upper surface of the casing 10 is flush. Therefore, it is possible to effectively use the space on top of the printer 1 by temporarily putting recording paper, etc., on top of the casing 10.

Next, referring to FIG. 2, the operation from when the recording paper 40 is supplied until when the recording paper 40 is ejected will be described.

When supplying the recording paper 40, the lid 23 of the paper supply section 13 is first opened, and then the recording paper 40 is inserted through the paper supply port 11. The inserted recording paper 40 is accommodated in the paper supply section 13, with the lower edge portion thereof being supported by the protrusion 29. Normally, a plurality of sheets of the recording paper 40 are accommodated. Of course, only one sheet of the recording paper 40 may be accommodated.

In a recording operation, the protrusion 29 is retracted down while the inclined plate 28 is moved so that the lower edge portion of the inclined plate 28 is moved rightward. Thus, one sheet of the recording paper 40 that is at the top of the stack on the inclined plate 28 is brought into contact with the pickup roller 30, and the recording paper 40 is drawn by the rotation of the pickup roller 30. Then, the recording paper 40 is carried into the recording section 17 by the paper supply roller 32.

In the recording section 17, ink droplets are discharged from the ink jet head 18 toward the recording paper 40. The ink droplets land on the recording paper 40, thereby forming a plurality of ink dots on the recording paper 40. Thus, an intended image, or the like, is formed on the recording paper 40 by the ink dots.

The recording paper 40, on which an image, or the like, has been formed, is carried by the paper eject roller 47, and after the paper path is changed by the redirecting plate 50, the recording paper 40 is carried by the drive roller 51 into the paper eject section 15. A trailing edge portion (an about ⅓ portion from the trailing edge) of the recording paper 40 carried into the paper eject section 15 is pushed rightward by the pusher member 53, whereby the recording paper 40 is accommodated in an upright position in the paper eject section 15. Note that the term "upright position" refers to any of various positions as illustrated in FIG. 9A to FIG. 9E, for example.

At this time, the pusher member 53 pushes the trailing edge portion of the recording paper 40 while passing through the paper partition (restricting plate) 60. Then, while the recording paper 40 is accommodated in the paper eject section 15, the pusher member 53 is preferably kept in the position at which it presses the recording paper 40 rightward. Thus, it is preferred that the recording paper 40 is held between the right-side plate 27 and the pusher member 53, thereby preventing the trailing edge portion of the recording paper 40 from moving around and the recording paper 40 from being bent or warped. Then, when taking out the recording paper 40 from the paper eject section 15 or when the next sheet of the recording paper 40 is carried into the paper eject section 15, the pusher member 53 is returned to its left position to release the hold.

The paper carrying operation and the recording operation are repeated for each sheet of the recording paper 40. As a result, a plurality of sheets of the recording paper 40 are accommodated in the paper eject section 15. Then, when the user turns ON the eject switch 58, the lid 24 of the paper eject section 15 is opened, and the recording paper 40 is lifted up by the moving plate 57. As a result, a part of the recording paper 40 projects from the paper eject port 12, whereby the user can easily take out the recording paper 40.

Figure 10:
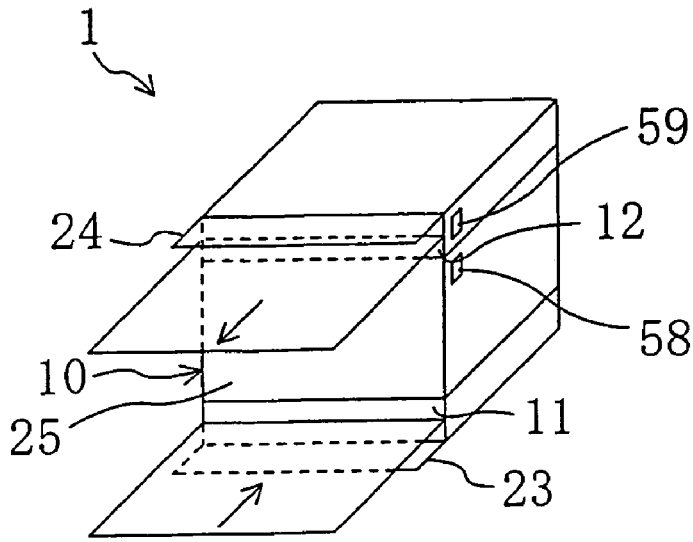
FIG. 10 is a perspective view illustrating a printer in a horizontal position.
Figure 11:
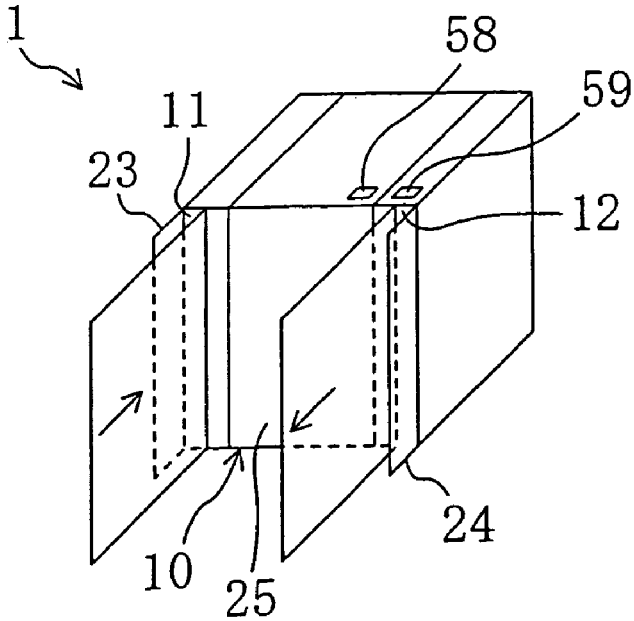
FIG. 11 is a perspective view illustrating a printer in a horizontal position.

While a case where the printer 1 is placed in an upright position has been described above, the printer 1 can alternatively be placed in a horizontal position. In such a case, the moving plate 57 is moved horizontally instead of vertically. Specifically, the printer 1 can be placed in a horizontal position such that the recording paper 40 is supplied and ejected horizontally, as illustrated in FIG. 10, or in another horizontal position such that the recording paper 40 is supplied and ejected vertically, as illustrated in FIG. 11. The printer 1 can be freely placed either in an upright position or in a horizontal position depending on the installation space and the installation environment.

As described above, the printer 1 as a whole has a reduced thickness, with the paper supply section 13 and the paper eject section 15 being arranged parallel to each other. Therefore, it is possible to reduce the size of the printer and to reduce the installation space therefor. This will eliminate the need for a conventional printer rack, and the like, and when the printer is placed in an upright position, for example, it can be installed in a small space such as beside a television set or a tower-type personal computer. It will also fit well in a living room.

When placed in an upright position, the paper supply section 13 and the paper eject section 15 each extend in a vertical direction, whereby the printer 1 is unlikely to fall over. Particularly, in the present embodiment, the paper supply section 13 and the paper eject section 15 are on the opposite sides of the main body section 70, whereby the center of gravity of the printer 1 as a whole is likely to be at or near the center of the casing 10. Thus, there is little possibility for the printer 1 to fall over. Moreover, the vibration during a recording operation is suppressed, thereby making the recording operation stable while improving the printing quality.

Since the pickup roller 30 and the paper supply roller 32 overlap with each other in the longitudinal direction of the casing 10, the thickness of the casing 10 can be reduced.

Since the pusher member 53 is arranged so as to push the recording paper 40 from one side of the paper eject section 15 that is closer to the paper supply section 13, the paper path of the recording paper 40 can be reduced. Thus, the recording paper 40 can be carried into the paper eject section 15 in a short period of time.

Since the ink jet head 18 is used as a recording head of the recording section 17, the size of the recording section 17 can be reduced. Moreover, a high-quality image can be obtained.

Since the angle θ between the paper carrying direction D1 in the recording section 17 and the paper carrying direction D2 toward the paper eject section 15, is less than 180°, the recording paper 40 on the platen 34 is pressed against the platen 34 by virtue of the restoring force of the recording paper 40 itself Therefore, the trailing edge portion of the recording paper 40 is prevented from being lifted up off the platen 34. Thus, the position of the recording surface of the recording paper 40 does not move, thereby improving the recording quality. Moreover, the trailing edge portion of the recording paper 40 is not brought into contact with the ink jet head 18, thereby preventing the ink jet head 18 from being damaged by the recording paper 40.

Moreover, in an ink jet recording operation, ink dots are formed by ink droplets landing on the recording paper 40. When the ink droplets land on the recording paper 40, the solvent contained in the ink evaporates immediately. Then, the recording paper 40 contracts, and a crease or corrugation may occur in the recording paper 40, thereby changing the interval between the ink jet head 18 and the recording paper 40 and thus deteriorating the recording quality. However, a crease or corrugation is prevented from occurring in the recording paper 40, as the angle θ between the paper carrying direction D1 and the paper carrying direction D2 toward the paper eject section 15 is set to be less than 180°, whereby the recording paper 40 is pressed against the platen 34 by virtue of the restoring force of the recording paper 40 itself.

With an apparatus that uses a multi-piece spur roller as the spur roller 48 for giving a tension to the recording paper 40, the tension on the recording paper 40 is likely to be small only with the spur roller 48. Moreover, the tension on the recording paper 40 is likely to be non-uniform. However, with the printer 1 of the present embodiment, the recording paper 40 is pressed against the platen 34 by virtue of the restoring force of the recording paper 40 itself, whereby the recording paper 40 is pressed against the platen 34 uniformly across the recording paper 40 and with an appropriate force. Therefore, despite the use of a multi-piece spur roller, the recording surface of the recording paper 40 can be flattened sufficiently.

Figure 12A:
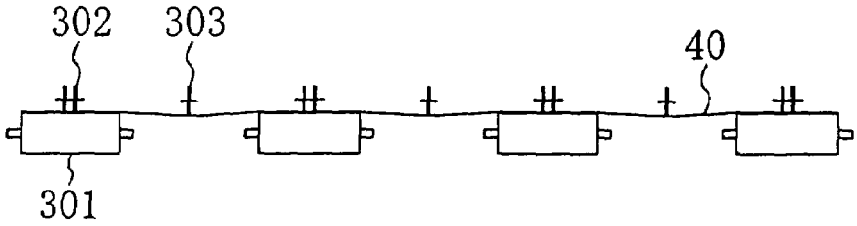
FIG. 12A is a front view illustrating a conventional eject-side paper carrying mechanism.

A conventional recording apparatus includes a spur roller 303 that is not opposing a paper eject roller 301, in addition to a spur roller 302 that is opposing the paper eject roller 301, as illustrated in FIG. 12A, in order to give a sufficient tension to the recording paper 40. A driving force for carrying the recording paper is generated by the paper eject roller 301 and the spur roller 302, while a tension is generated by the spur roller 303.

Figure 12B:
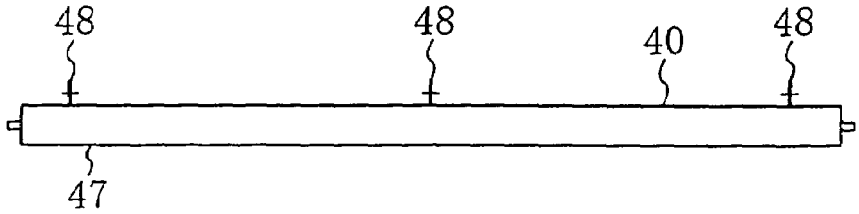
FIG. 12B is a front view illustrating an eject-side paper carrying mechanism according to one embodiment of the present invention.

In contrast, with the printer 1, the tension is generated primarily by the restoring force of the recording paper 40 itself, as described above, whereby it is only required for the paper eject roller 47 and the spur roller 48 to generate the driving force for carrying the recording paper 40. Therefore, unlike the conventional recording apparatus, it is not necessary to provide a spur roller that is not opposing a paper eject roller. Thus, the paper eject roller 47 can be formed as a continuous single round bar, as illustrated in FIG. 12B. Unlike the conventional recording apparatus, it is not necessary to provide a plurality of rollers to form a paper eject roller, and it is possible to reduce the number of spur rollers. Therefore, it is possible to reduce the cost of the apparatus.

Since the surface of the paper eject roller 47 is covered with a rubber, the recording paper 40 is unlikely to slip, whereby it is possible to improve the driving force for carrying the recording paper 40.

When the printer 1 is placed in an upright position, the trailing edge portion of the recording paper 40 being introduced into the paper eject section 15 is pushed into the paper eject section 15 by the pusher member 53, whereby it is possible to more reliably prevent a jam from occurring. When a plurality of sheets of the recording paper 40 are printed successively, if a trailing edge portion of a previously printed sheet of the recording paper 40 is left in the vicinity of the drive roller 51 and the counter roller 52, a leading edge portion of a later printed sheet of the recording paper 40 is more likely to contact the trailing edge portion of the previously printed sheet, thereby causing a jam. However, according to the present embodiment, the trailing edge portion of the previously printed sheet of the recording paper 40 is pushed by the pusher member 53 toward the right-side plate 27 of the paper eject section 15, whereby the previously printed sheet does not interfere with the path of the later printed sheet, thus preventing a jam from occurring.

Since the pusher member 53 pushes the recording paper 40 into the paper eject section 15, it is possible to carry the recording medium into the paper eject section 15 without providing an eject-side paper carrying mechanism at a position that is higher than the bottom of the paper eject section 15. Thus, the position at which an eject-side paper carrying mechanism is provided is not restricted, and it is possible to reduce the size of the apparatus.

The recording section 17 is surrounded by other elements in a lower portion of the casing 10, thereby preventing the user from inadvertently touching the recording section 17. Thus, the user is prevented from damaging the recording section 17 inadvertently.

Moreover, the printed recording paper 40 is accommodated in the paper eject section 15, which is closed from the outside. Therefore, unlike a conventional printer in which the recording paper is ejected from the printer 1 immediately after the printing operation, the user does not touch the recording surface of the recording paper 40 immediately after the printing operation. Therefore, the recording paper 40 is taken out after the recoding surface thereof is sufficiently dried, thus preventing problems such as a smudge of a print.

Since the paper supply section 13 and the paper eject section 15 are provided with the lids 23 and 24, respectively, which can be opened/closed, it is possible to prevent dust and dirt from entering the paper supply section 13 or the paper eject section 15. Therefore, it is possible to improve the reliability of the printer 1 and to prolong the operating lifetime thereof.

With the provision of the eject completion indicator 59, the user can easily check the presence/absence of the recording paper 40 in the paper eject section 15.

With the provision of the eject switch 58, which can be turned ON to open the lid 24 of the paper eject section 15, it is possible to open the paper eject section 15 only when taking out the recording paper 40.

Variations

Figure 13:
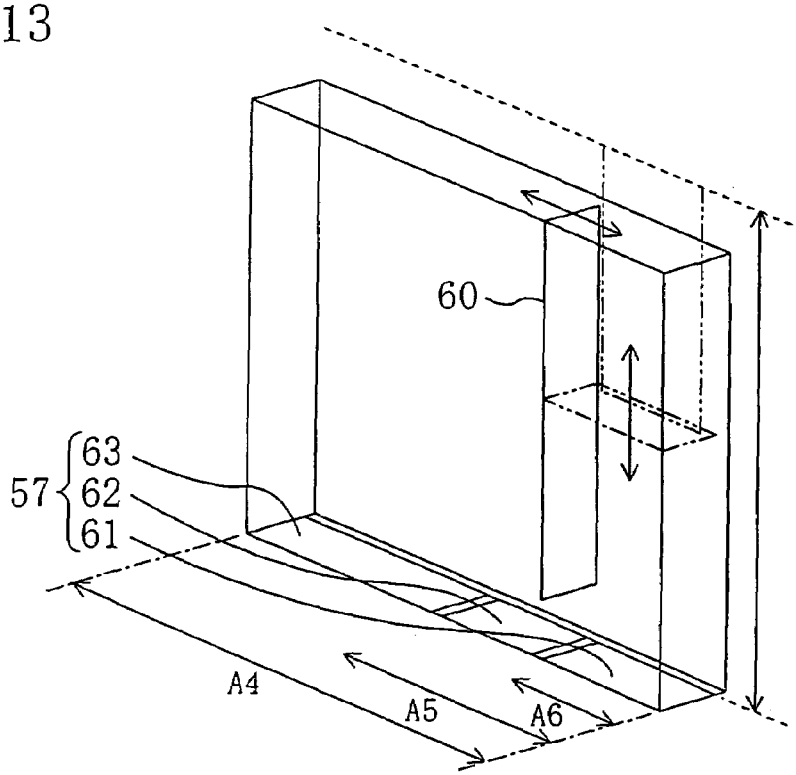
FIG. 13 is a perspective view illustrating an important part of a paper eject section.

Note that the moving plate 57 for lifting up the recording paper 40 can be provided by a plurality of separate moving plates 61, 62 and 63, as illustrated in FIG. 13, instead of using a single plate with the through holes 64 and 65 formed therein. In such a case, the moving plates 61, 62 and 63, may be moved up and down all together, or only one or two of them may be moved up and down according to the paper size.

The paper path angle θ is not limited to the values shown above, but may take any value that is equal to or greater than 0° and less than 180°, as long as a downward force acts on the trailing edge portion of the recording paper 40.

While the eject switch 58 is turned ON by the user when taking out the recording paper 40 in the embodiment described above, the present invention is not limited to such a manual operation. Alternatively, it is possible to open the lid 24 and move the moving plate 57 automatically upon completion of a predetermined recording operation.

Moreover, while the supply-side paper accommodating section for accommodating the recording paper 40 before the printing operation is formed by the left-side plate 26, the partition plate 19 and the partition plate 21 of the paper supply section 13 in the embodiment described above, the supply-side paper accommodating section may alternatively be provided in the form of a cassette. Similarly, while the eject-side paper accommodating section for accommodating the recording paper 40 after the printing operation is formed by the right-side plate 27, the partition plate 20 and the partition plate 22 of the paper eject section 15 in the embodiment described above, the eject-side paper accommodating section may alternatively be provided in the form of a cassette. In this way, the use of the printer 1 can be made more convenient in a case where a large amount of recording paper 40 is supplied and taken out at once.

Embodiment 2

Figure 14:
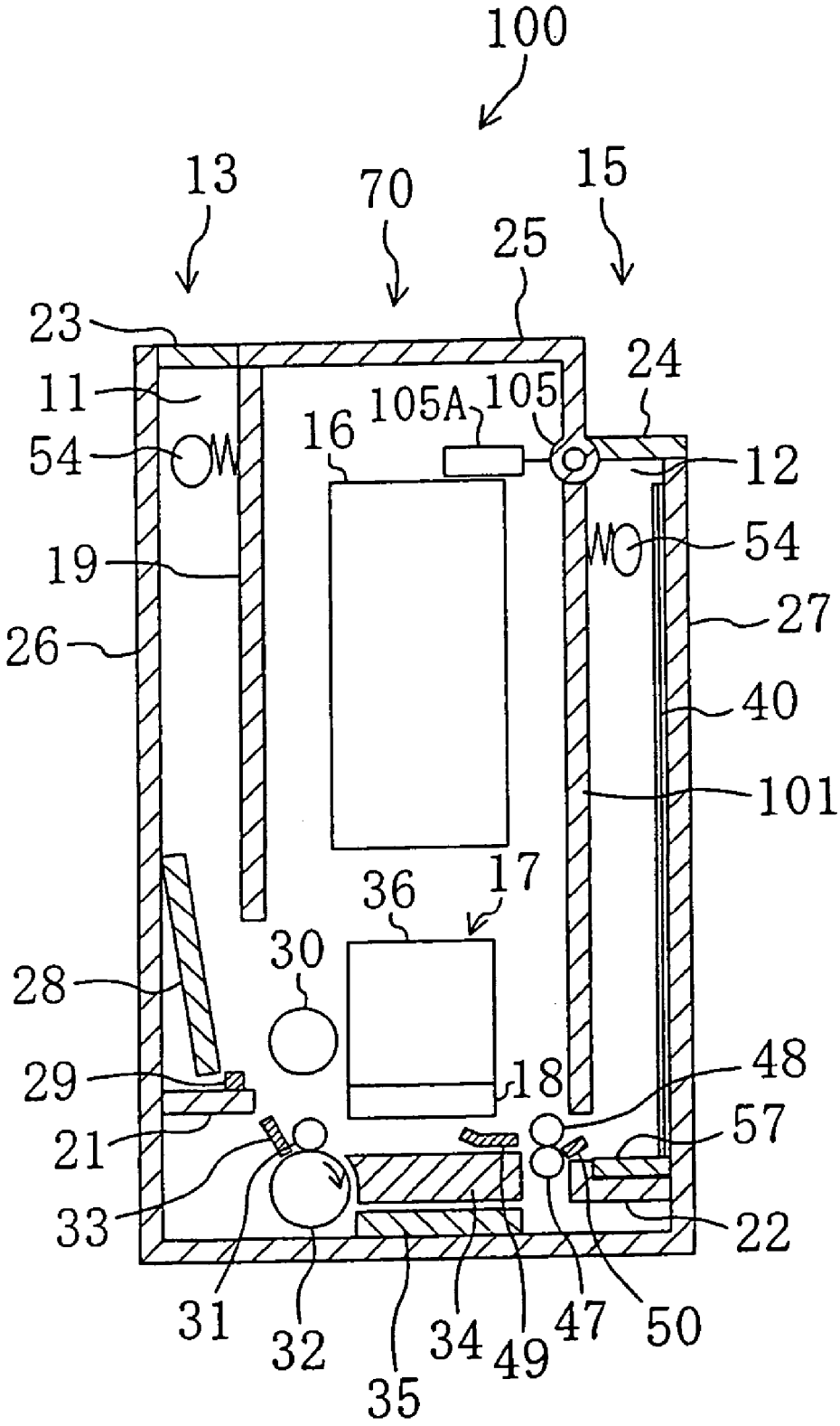
FIG. 14 is a cross-sectional view illustrating a printer.

As illustrated in FIG. 14, a printer 100 according to Embodiment 2 includes the partition plate 22 of the paper eject section 15 provided at a position lower than the surface of the platen 34 of the recording section 17, while omitting the drive roller 51, the counter roller 52, etc. (see FIG. 2) for guiding the recording paper 40 from the recording section 17 to the paper eject section 15.

In the printer 100, the paper eject port 12 of the paper eject section 15 is provided at a position lower than the paper supply port 11 of the paper supply section 13, thereby forming a step at the top of the paper eject section 15. Note however that the paper eject port 12 may alternatively be provided at the same height as the paper supply port 11, as in Embodiment 1. The partition plate 22 of the paper eject section 15 is provided at a position lower than the partition plate 21 of the paper supply section 13.

Figure 15A:
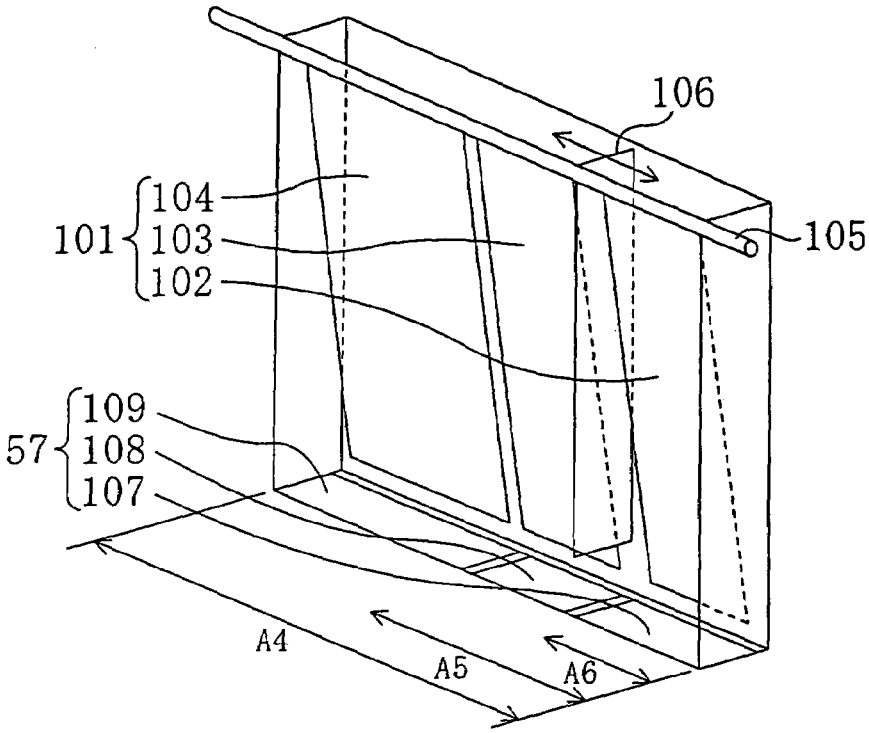
FIG. 15A and FIG. 15B are perspective views each illustrating an important part of a paper eject section.
Figure 15B:
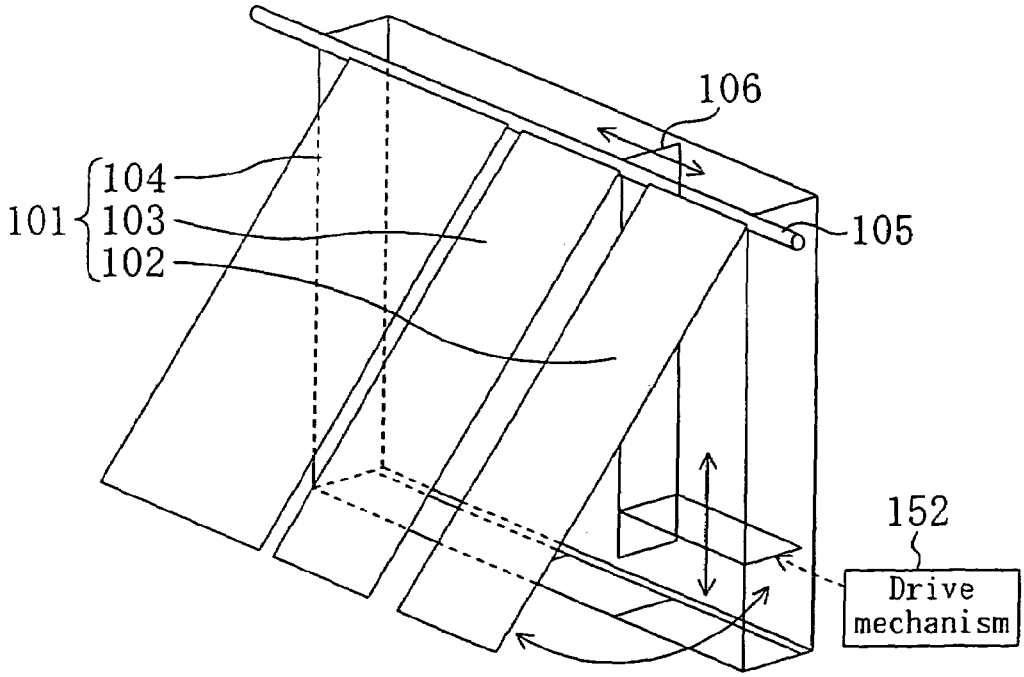

As pusher means for pushing the recording paper 40, which has been carried from the recording section 17 to the paper eject section 15, into the paper eject section 15, the printer 100 includes a pivoting pusher plate 101, as illustrated in FIG. 15A and FIG. 15B, instead of the sliding pusher member 53 as in Embodiment 1. The pusher plate 101 is provided with a drive mechanism 105A (see FIG. 14).

The pusher plate 101 is divided into a plurality of plates according to the paper sizes of the recording paper 40, i.e., a first pusher plate 102, a second pusher plate 103 and a third pusher plate 104. The upper edge of each of the pusher plates 102 to 104 is fixed to a rotating shaft 105. The rotating shaft 105 is provided at an upper left corner of the paper eject section 15. Moreover, the pusher plate 101 functions also as one of the partition plates defining the paper eject section 15 (i.e., the left side wall). Thus, two functions are provided by one member, thereby saving the space and the cost. In this way, the pusher plate 101 pivots about its upper edge portion as the rotating shaft 105 is rotated.

When recording paper 40 is carried into the paper eject section 15, the pusher plate 101 pivots toward the recording section 17 (see FIG. 15B) so as to expand the entrance portion of the paper eject section 15, through which the recording paper 40 is introduced into the paper eject section 15, thereby facilitating the guiding of the recording paper 40 into the paper eject section 15. On the other hand, after the recording paper 40 is carried into the paper eject section 15, the pusher plate 101 pivots toward the right-side plate 27 (see FIG. 15A), thereby pressing the recording paper 40 with the paper holding mechanism 54 (not shown in FIG. 15A and FIG. 15B) against the right-side plate 27 of the paper eject section 15.

The paper eject section 15 is provided with a paper partition 106 that is movable in the front-back direction (i.e., the width direction of the recording paper 40). The paper partition 106 is provided for adjusting the size of the space of the paper eject section 15 according to the size of the recording paper 40. An interval that is larger than the thickness of the paper partition 106 is formed between the pusher plates 102 and 103 and between the pusher plates 103 and 104 so that the pusher plates 102 to 104 do not collide with the paper partition 106 during the pushing operation.

The first pusher plate 102 is formed with a size corresponding to A6-size paper. The second pusher plate 103 is formed with a size such that the total size of the pusher plates 102 and 103 corresponds to A5-size paper. The third pusher plate 104 is formed with a size such that the total size of the pusher plates 102 to 104 corresponds to A4-size paper. When the recording paper 40 is A6-size paper, the paper partition 106 is positioned between the first pusher plate 102 and the second pusher plate 103. When the recording paper 40 is A5-size paper, the paper partition 106 is positioned between the second pusher plate 103 and the third pusher plate 104. When the recording paper 40 is A4-size paper, the paper partition 106 is positioned on the back side (the left side in FIG. 15A and FIG. 15B) of the third pusher plate 104.

Moreover, in the printer 100, the moving plate 57 is also divided into a plurality of plates according to the paper sizes of the recording paper 40, i.e., a first moving plate 107, a second moving plate 108 and a third moving plate 109. The moving plates 107 to 109 are provided with the drive mechanism 152 for moving the moving plates 107 to 109 up and down. An interval that is larger than the thickness of the paper partition 106 is also provided between the moving plates 107 and 108 and between the moving plates 108 and 109.

Note that the plates 102 to 104 of the pusher plate 101 may be pivoted together or separately. Moreover, the plates 107 to 109 of the moving plate 57 may be moved together or separately.

The printer 100 of the present embodiment can be positioned either in an upright position or in a horizontal position, as the printer 1 of Embodiment 1.

Also in the present embodiment, the recording paper 40 is pushed by the pusher plate 101 into the paper eject section 15, whereby the recording paper 40 after the recording operation can be smoothly carried into the paper eject section 15.

In addition, the pusher plate 101 is a pivoting plate, whereby a space for accommodating a pusher member does not need to be provided between the recording section 17 and the paper eject section 15, as does in Embodiment 1. Therefore, it is possible to further reduce the size of the printer.

In the present embodiment, the partition plate 22 is provided at a position lower than the surface of the platen 34, whereby it is not necessary to provide an introduction mechanism (the drive roller 51, the counter roller 52, etc., in Embodiment 1) for introducing the recording paper 40, which has passed through the paper eject roller 47, into the paper eject section 15. Therefore, it is possible to reduce the number of components and to further reduce the size of the printer. Moreover, since the paper eject path is shortened, it is possible to shorten the paper eject time.

Variations

Figure 16:
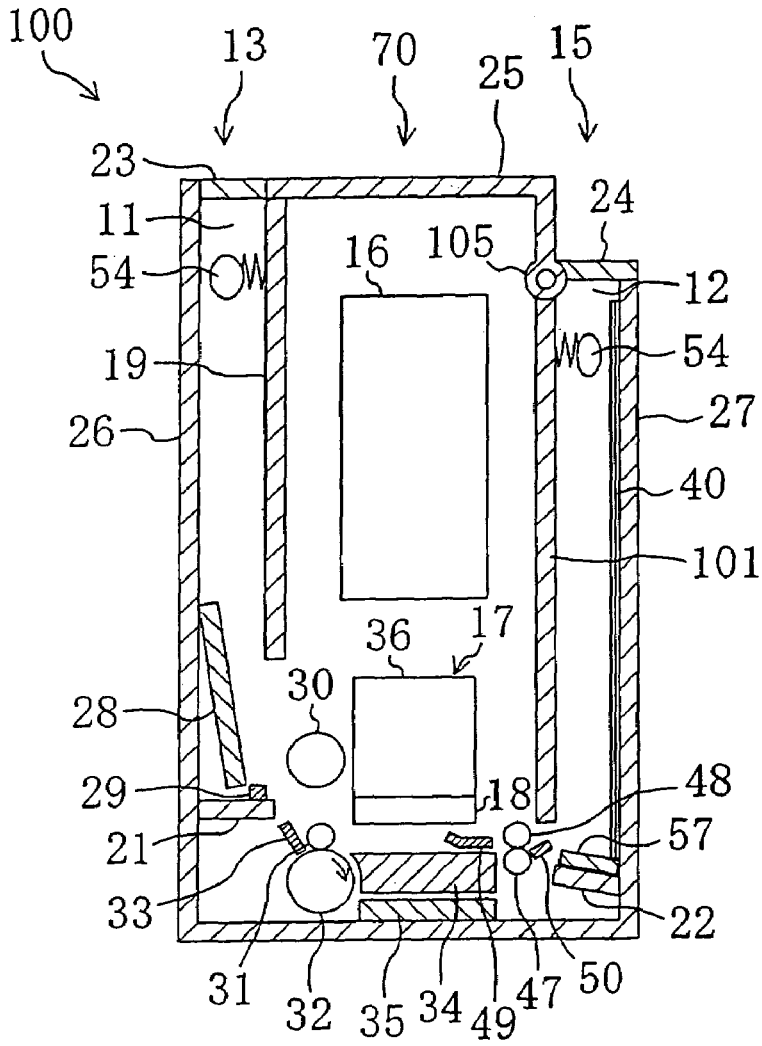
FIG. 16 is a cross-sectional view illustrating a printer.
Figure 17A:
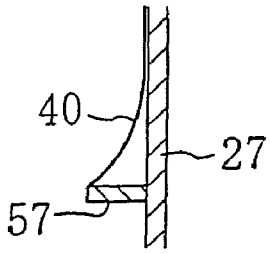
FIG. 17A and FIG. 17B are diagrams illustrating how recording paper is bent in a paper eject section.
Figure 17B:
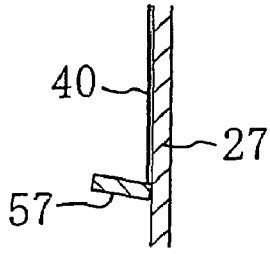

In the embodiment described above, the partition plate 22 and the moving plate 57 of the paper eject section 15 are each formed in a flat plate shape extending in the horizontal direction. However, as illustrated in FIG. 16, each of the partition plate 22 and the moving plate 57 may alternatively be an inclined plate, with one end thereof closer to the recording section 17 being higher than the other end. In this way, the lower edge portion of the recording paper 40 is subject to a force toward the right-side plate 27. Therefore, it is possible to prevent the recording paper 40 from bending as illustrated in FIG. 17A and to keep the recording paper 40 in an upright position as illustrated in FIG. 17B.

Figure 18:
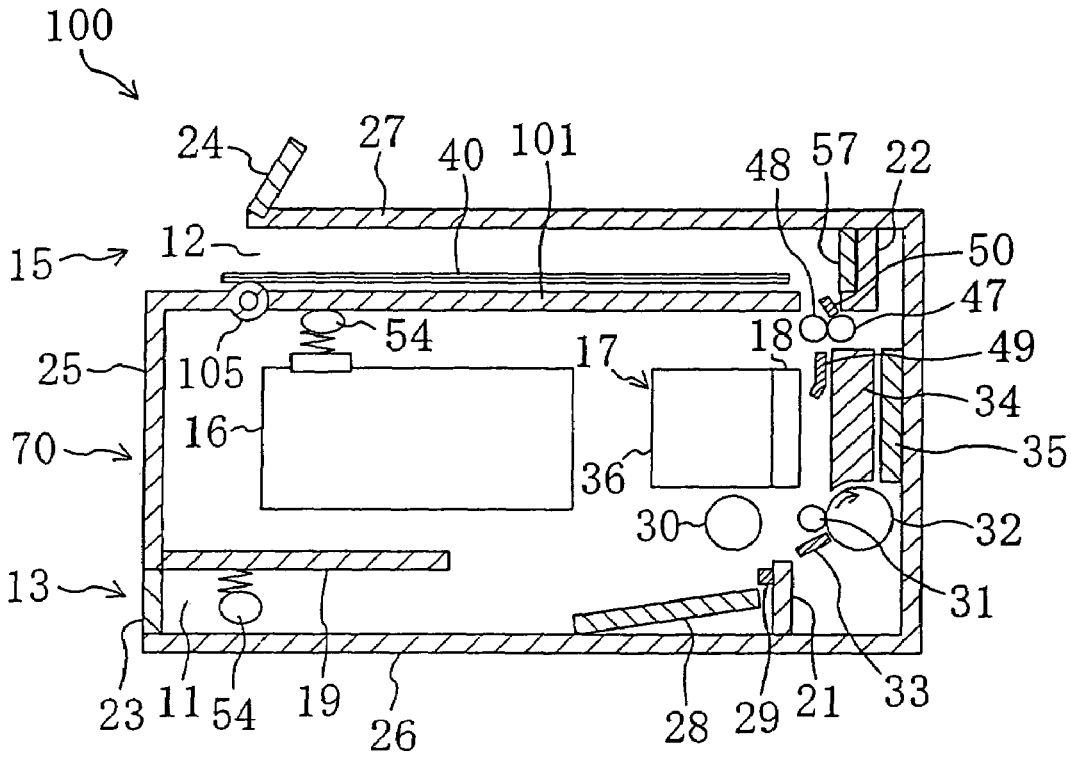
FIG. 18 is a cross-sectional view illustrating a printer.

The paper holding mechanism 54 may be provided between the pusher plate 101 and the control section 16, as illustrated in FIG. 18. The provision of the paper holding mechanism 54 on the side of the pusher plate 101 that is closer to the control section 16 makes it easy to place the recording paper 40 on the upper surface (the surface closer to the right-side plate 27) of the pusher plate 101 in a case where the printer 100 is placed in a horizontal position. Specifically, in the absence of the paper holding mechanism 54 on the upper surface of the pusher plate 101, the pusher plate 101 provides a flat upper surface on which the recording paper 40 can easily be stacked. Therefore, the recording paper 40 can be accommodated in a better arrangement, thus improving the accommodation of the recording paper 40.

In a horizontal position, when the recording paper 40 is introduced between the paper eject roller 47 and the spur roller 48 into the paper eject section 15, it is preferred that the moving plate 57 is slightly moved in the horizontal direction so as to push the trailing edge portion of the recording paper 40 into the paper eject section 15. In this way, the recording paper 40 is guided to an appropriate position in the paper eject section 15.

In a horizontal position, the leading edge portion of the recording paper 40 being introduced into the paper eject section 15 may contact the lid 24 of the paper eject section 15, thereby bending the leading edge portion of the recording paper 40, depending on the size of the recording paper 40. In such a case, it is preferred that the recording paper 40 is introduced into the paper eject section 15 with the lid 24 being open. The lid 24 may be opened automatically when the recording paper 40 is introduced into the paper eject section 15.

Embodiment 3

Figure 19:
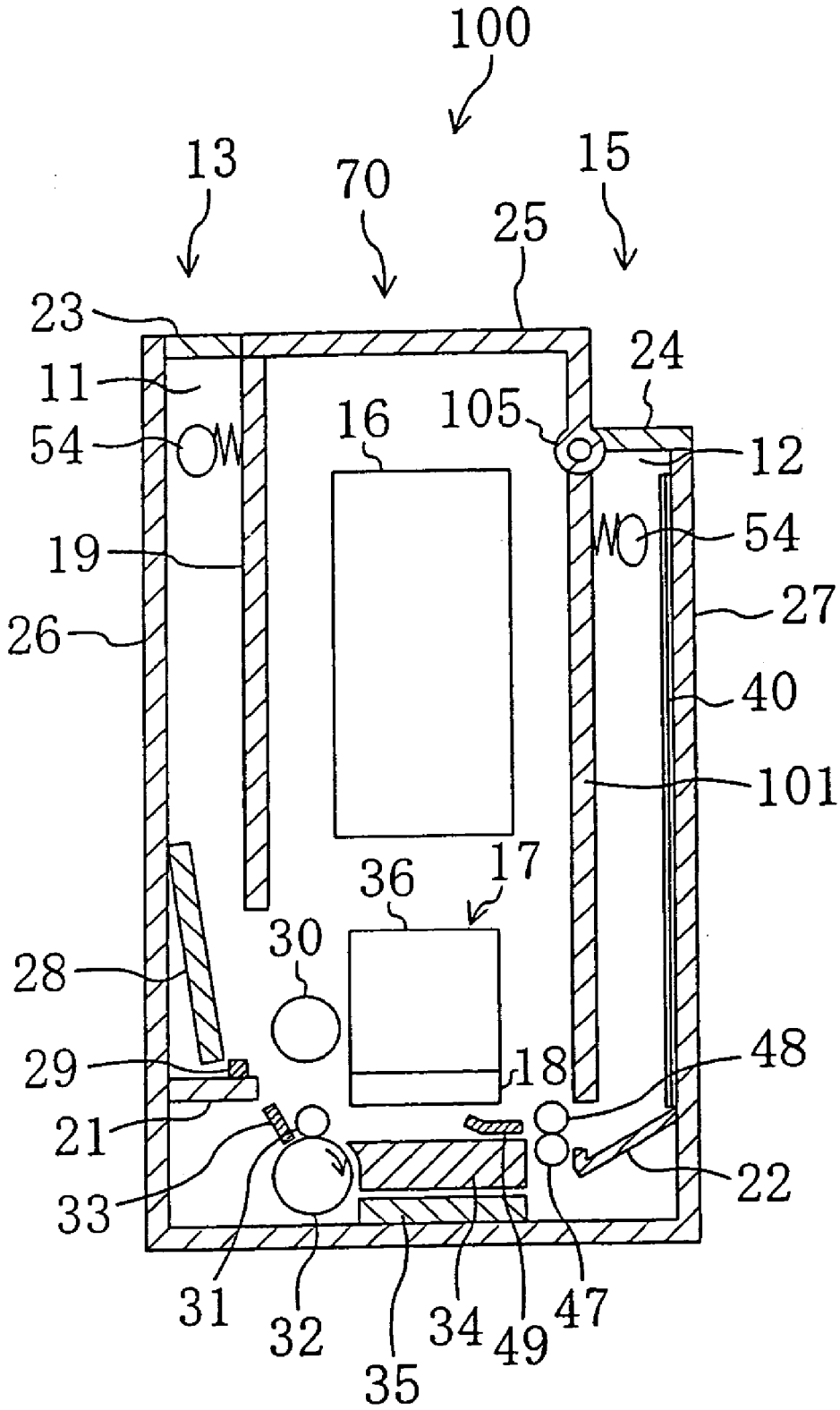
FIG. 19 is a cross-sectional view illustrating a printer.

As illustrated in FIG. 19, in a printer 110 according to Embodiment 3, the partition plate 22 of the paper eject section 15 is inclined, with one end thereof closer to the recording section 17 being lower than the other end, so that the partition plate 22 has a redirecting function, while omitting the redirecting plate 50 (see FIG. 2).

The partition plate 22 of the printer 110 extends to a position in the vicinity of the right side of the paper eject roller 47 and the spur roller 48, and the tip portion of the partition plate 22 is at a position lower than the surface of the platen 34. Therefore, as the recording paper 40 passes through between the paper eject roller 47 and the spur roller 48, the leading edge portion of the recording paper 40 moves along the upper surface of the partition plate 22, whereby the paper path is gradually changed from the rightward direction to the upward direction. Thus, in the present embodiment, the partition plate 22 of the paper eject section 15 forms a part of the paper path.

Note that the partition plate 22 may function as the moving plate 57. In such a case, the amount by which the recording paper projects can be constant for different paper sizes, thereby making it easier to take out the recording paper. In this way, the configuration of the apparatus is simplified, thereby further reduce the size and the cost of the apparatus.

As described above, according to the present embodiment, the redirecting plate 50 can be omitted and the number of components can be reduced. Moreover, it is possible to further shorten the paper path, and thus the paper eject time.

Note that the printer 110 can also be positioned either in an upright position or in a horizontal position.

Embodiment 4

Figure 20:
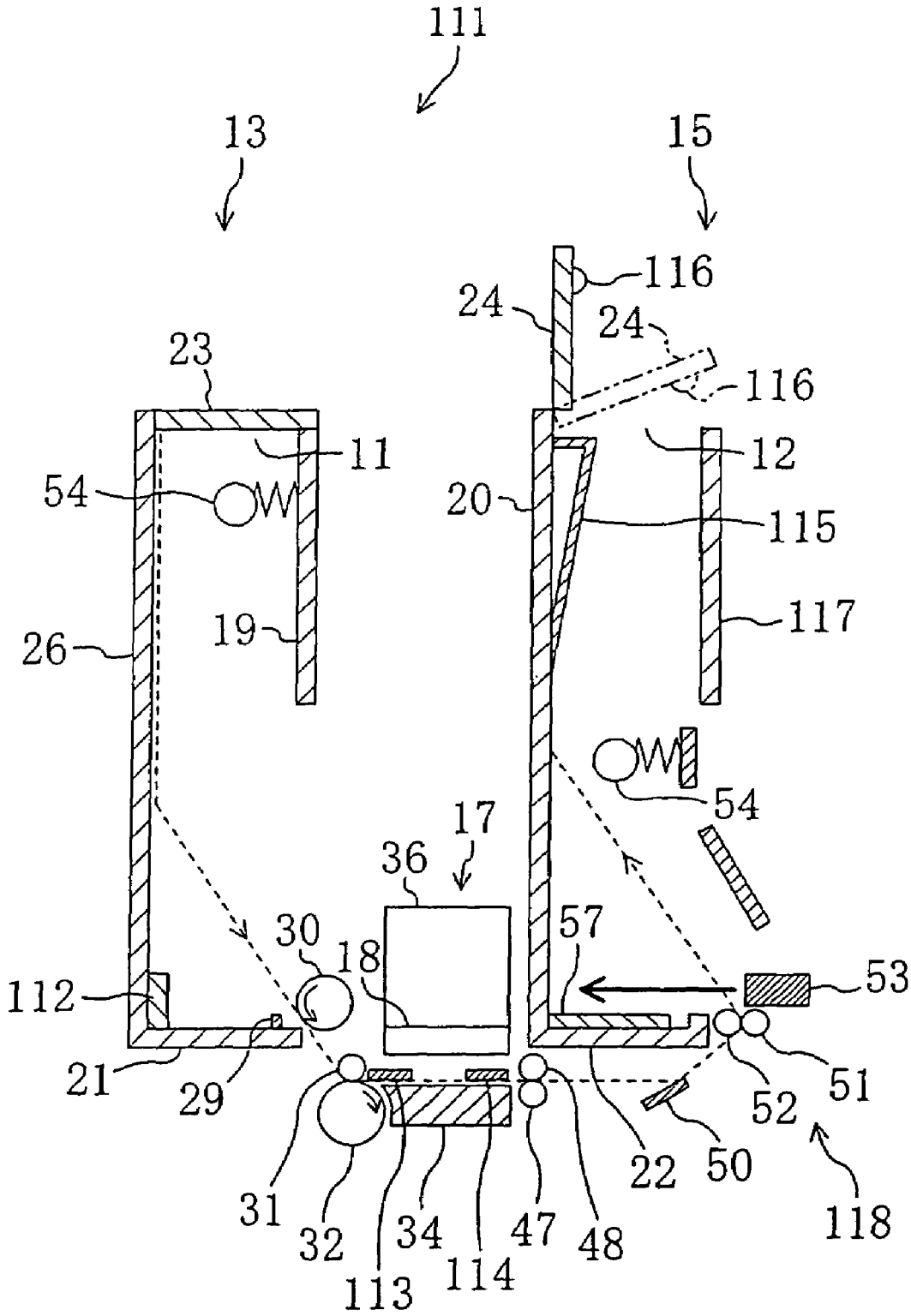
FIG. 20 is a cross-sectional view illustrating a printer.

As illustrated in FIG. 20, in a printer 111 according to Embodiment 4, the recording paper 40 from the recording section 17 is carried into the paper eject section 15 from the right side of the paper eject section 15.

In the present embodiment, the paper feed mechanism of the paper supply section 13 includes, instead of the inclined plate 28, a pusher plate 112 for pushing the lower edge portion of the recording paper 40 into the recording section 17. Therefore, the paper feed mechanism of the present embodiment is made up of the pusher plate 112, the protrusion 29 and the pickup roller 30. Note that the pusher plate 112 moves horizontally when the printer 111 is placed in an upright position, and vertically when the printer 111 is placed in a horizontal position.

Guide plates 113 and 114 for guiding the recording paper 40 to a position between the ink jet head 18 and the platen 34 are provided above the platen 34.

An introduction port 118 is provided below a right-side plate 117 of the paper eject section 15. The recording paper 40, whose path has been changed by the redirecting plate 50, is introduced into the paper eject section 15 through the introduction port 118. In the present embodiment, the drive roller 51 and the counter roller 52 are provided in the introduction port 118.

Figure 21:
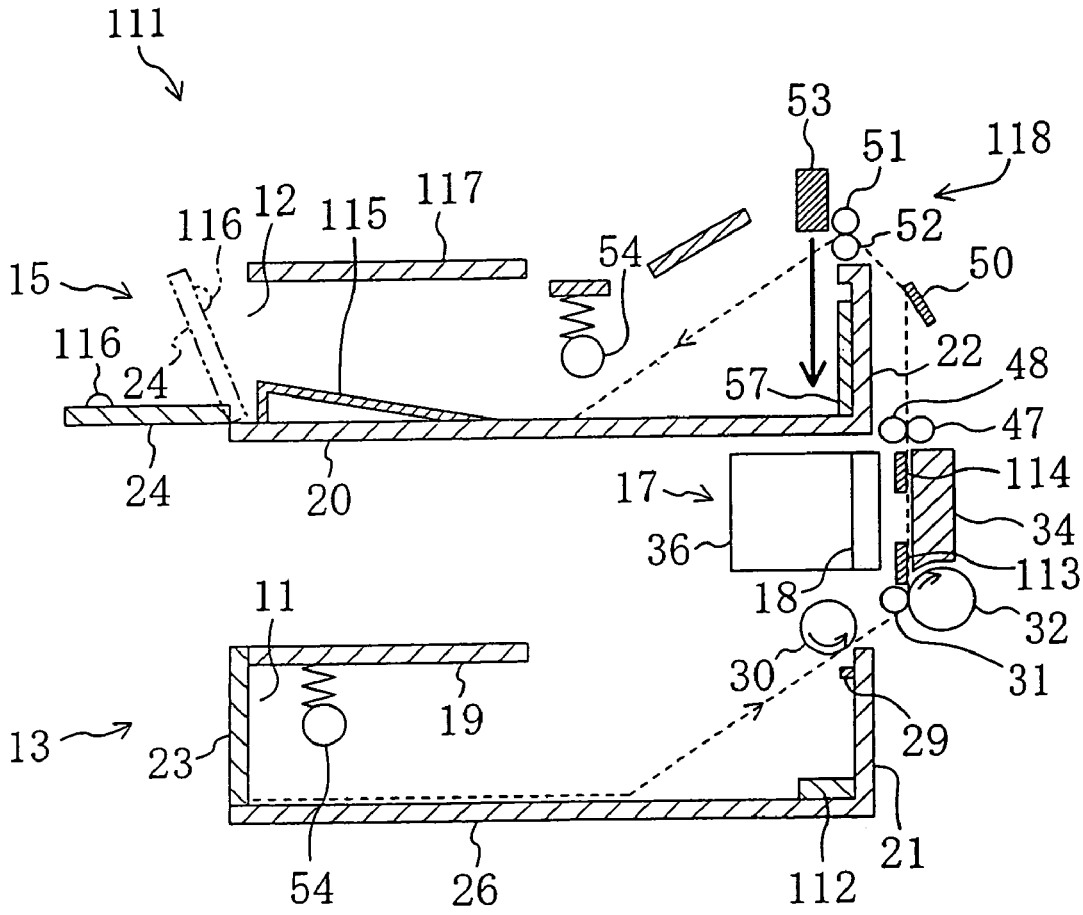
FIG. 21 is a cross-sectional view illustrating a printer.

In the present embodiment, the printed recording paper 40 is stacked on the partition plate 20 of the paper eject section 15. Therefore, the paper holding surface of the paper supply section 13 (i.e., the left-side plate 26) and that of the paper eject section 15 (i.e., the partition plate 20) are on the same side (the left side in FIG. 20) of each paper accommodating section (the term "paper holding surface" refers to a surface on which the recording paper 40 is stacked). Therefore, when the printer 111 is placed in a horizontal position as illustrated in FIG. 21, the paper holding surface of the paper supply section 13 and that of the paper eject section 15 are both the lower surface of each paper accommodating section. Moreover, in a horizontal position, the introduction port 118 of the paper eject section 15 is on the upper side of the paper eject section 15, thereby making it easy to carry the recording paper 40 into the paper eject section 15. The recording paper 40 can be carried into the paper eject section 15 by using gravity, whereby it is possible to carry the recording paper 40 into the paper eject section 15 more reliably.

Note that in order to make it easier to take out the recording paper 40 in a horizontal position, the partition plate 20 of the paper eject section 15 may be provided with an inclined plate 115, with one end thereof closer to the paper eject port 12 being higher than the other end. Moreover, in order to make it easier to pick up the leading edge portion of the recording paper 40 with the lid 24 being open, a protrusion 116 for raising the leading edge portion of the recording paper 40 may be provided on the inner surface of the lid 24.

The printer 111 of the present embodiment can also be positioned either in an upright position or in a horizontal position.

Embodiment 5

Figure 22:
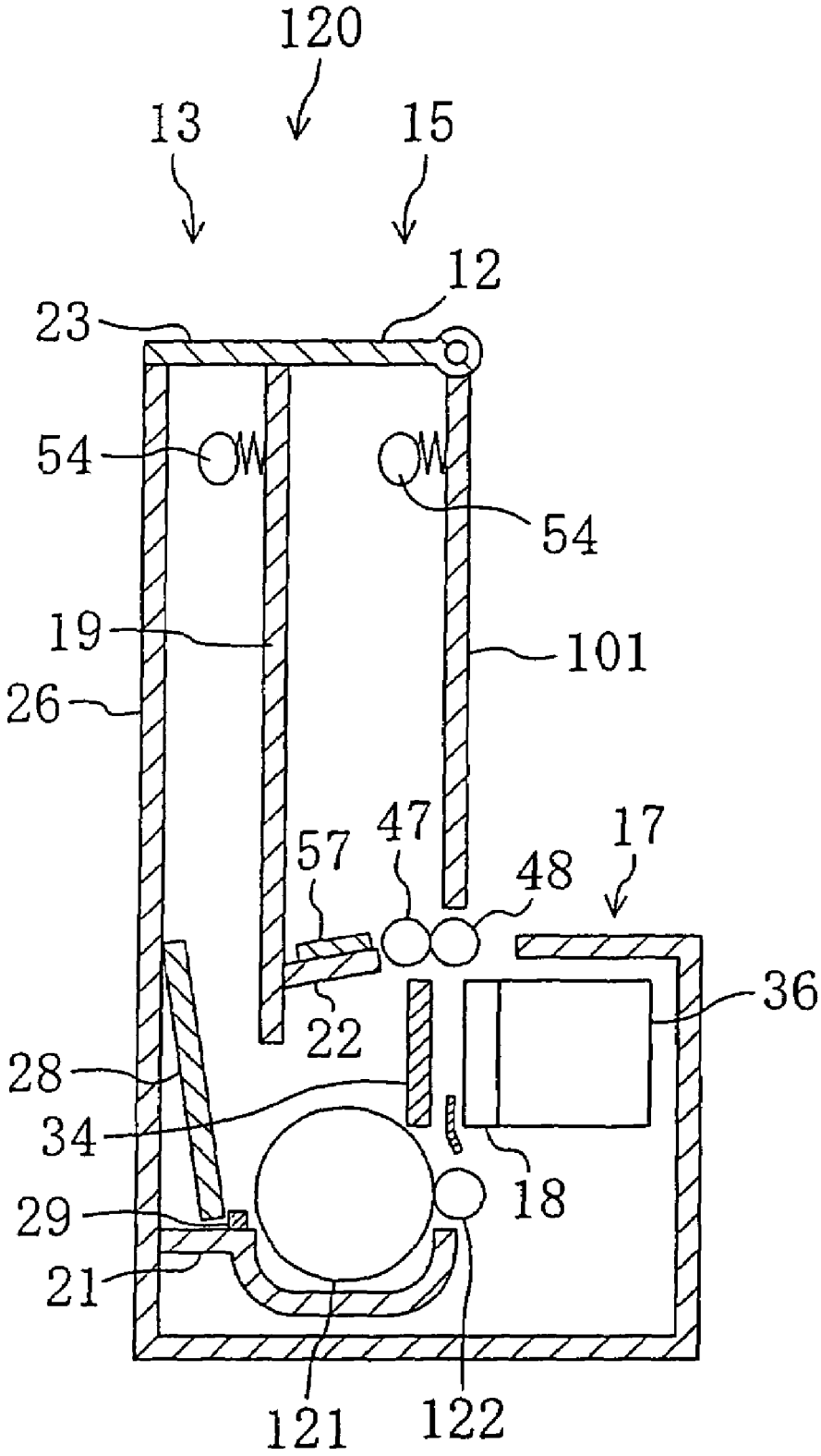
FIG. 22 is a cross-sectional view illustrating a printer.

As illustrated in FIG. 22, in a printer 120 according to Embodiment 5, the paper supply section 13 and the paper eject section 15 are positioned adjacent to each other, with the recording section 17 being provided on the outer side of the paper eject section 15.

In the present embodiment, a paper supply roller 111 that functions also as a pickup roller, is provided on the right side of the protrusion 29 of the partition plate 21. A counter roller 122 is provided on the right side of the paper supply roller 121. The recording section 17 is provided on the upper right side of the paper supply roller 121. The contact point between the paper supply roller 121 and the counter roller 122, the gap between the ink jet head 18 and the platen 34, and the contact point between the paper eject roller 47 and the spur roller 48 are aligned with one another in the vertical direction so that the recording paper 40 is carried in the vertical direction during a recording operation. In the present embodiment, the right-side plate of the paper eject section 15 is provided by the pusher plate 101 as that in Embodiment 2.

The printer 120 of the present embodiment can also be positioned either in an upright position or in a horizontal position.

Embodiment 6

Figure 23A:
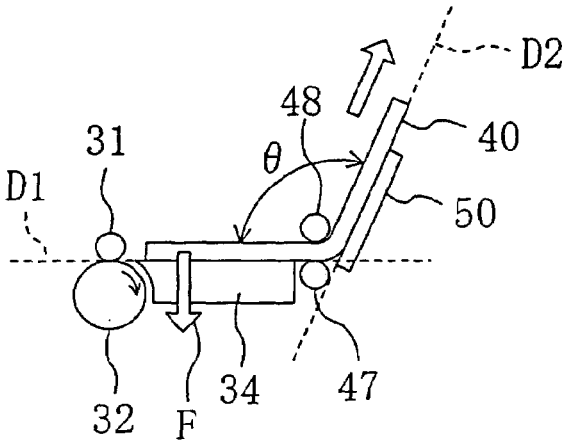
FIG. 23A to FIG. 23F are diagrams each illustrating a paper path along which recording paper is carried.
Figure 23B:
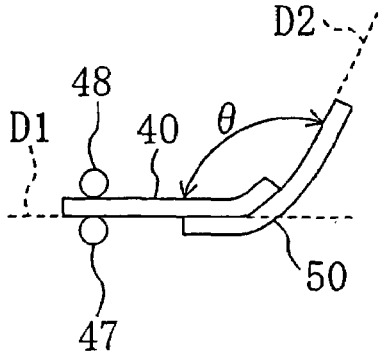
Figure 23C:
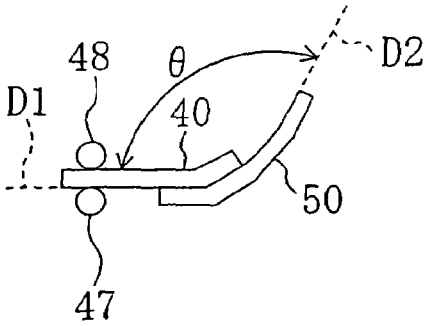
Figure 23D:
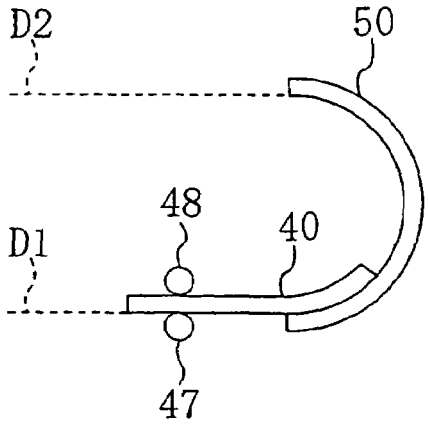

In Embodiment 1, the redirecting plate 50 is a flat plate, as illustrated in FIG. 23A. Alternatively, the redirecting plate 50 may be a non-flat plate, as illustrated in FIG. 23B, FIG. 23C or FIG. 23D. The term "non-flat plate" as used herein includes bent plates and curved plates. The paper path angle θ may change gradually, and it may decrease gradually.

Figure 23E:
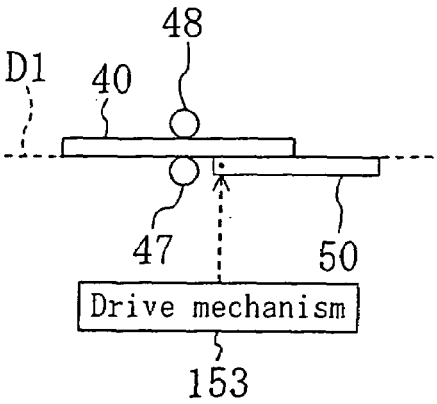
Figure 23F:
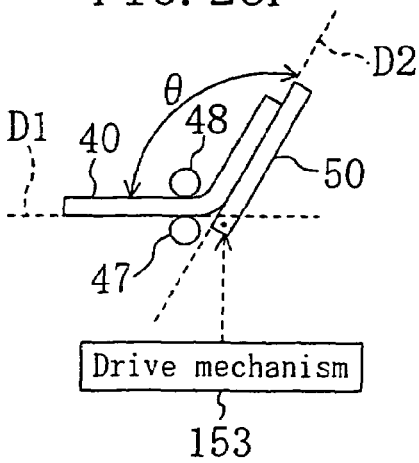

Particularly, it is preferred that a portion of the redirecting plate 50 that is first contacted by the recording paper 40 is parallel or approximately parallel to the paper carrying direction D1 so that the leading edge of the recording paper 40 hits the redirecting plate 50 with a reduced impact, whereby the speed at which the recording paper 40 is carried is not reduced. In this way, the paper carrying speed can be increased. Alternatively, the redirecting plate 50 may be a movable plate that is moved by a drive mechanism 153 capable of pivoting the redirecting plate 50, as illustrated in FIG. 23E and FIG. 23F. In such a case, the path of the recording paper 40 may be changed as follows. The redirecting plate 50 may be held substantially parallel to the paper carrying direction D1, as the leading edge portion of the recording paper 40 approaches the redirecting plate 50, after which the redirecting plate 50 is pivoted to a position that is substantially parallel to the paper carrying direction D2 before the leading edge portion of the recording paper 40 takes off the redirecting plate 50.

Embodiment 7

Figure 24:
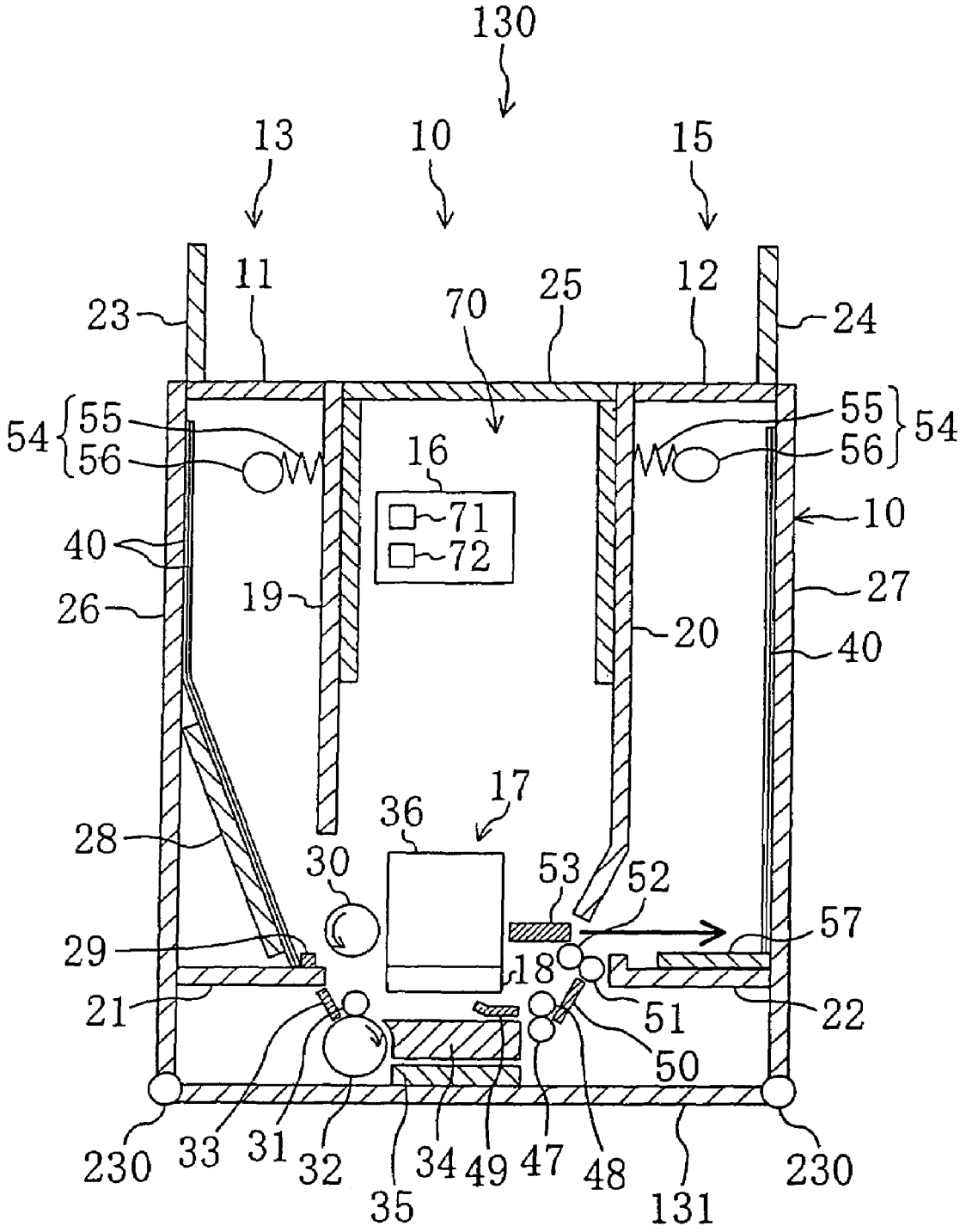
FIG. 24 is a cross-sectional view illustrating a printer.

As illustrated in FIG. 24, a printer 130 according to Embodiment 7 is an improved version of the printer 1 of Embodiment 1, wherein the left-side plate 26 and the right-side plate 27 can be pivoted with respect to a bottom plate 131.

Figure 25:
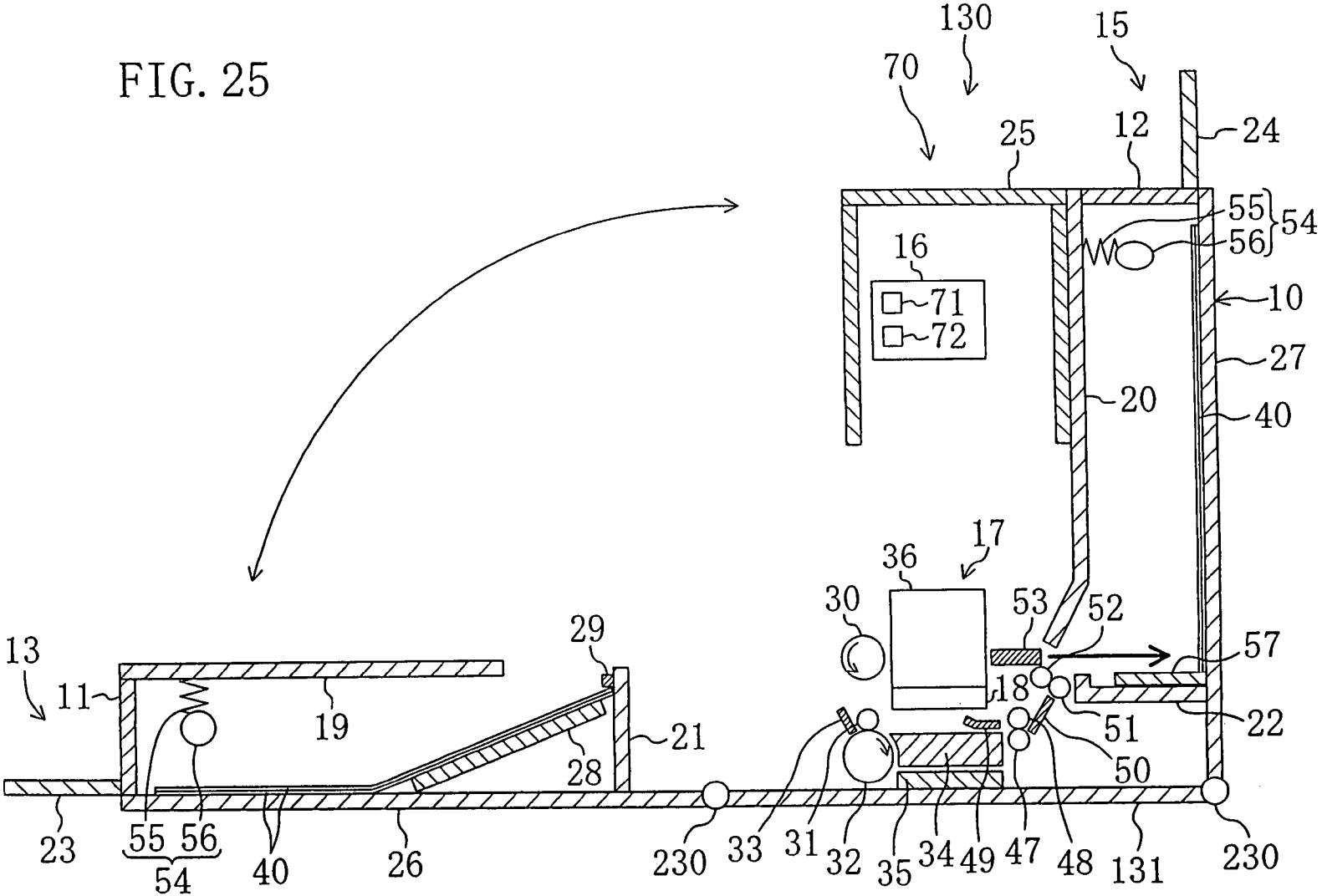
FIG. 25 is a cross-sectional view illustrating a printer with a paper supply section in its open position.
Figure 26:
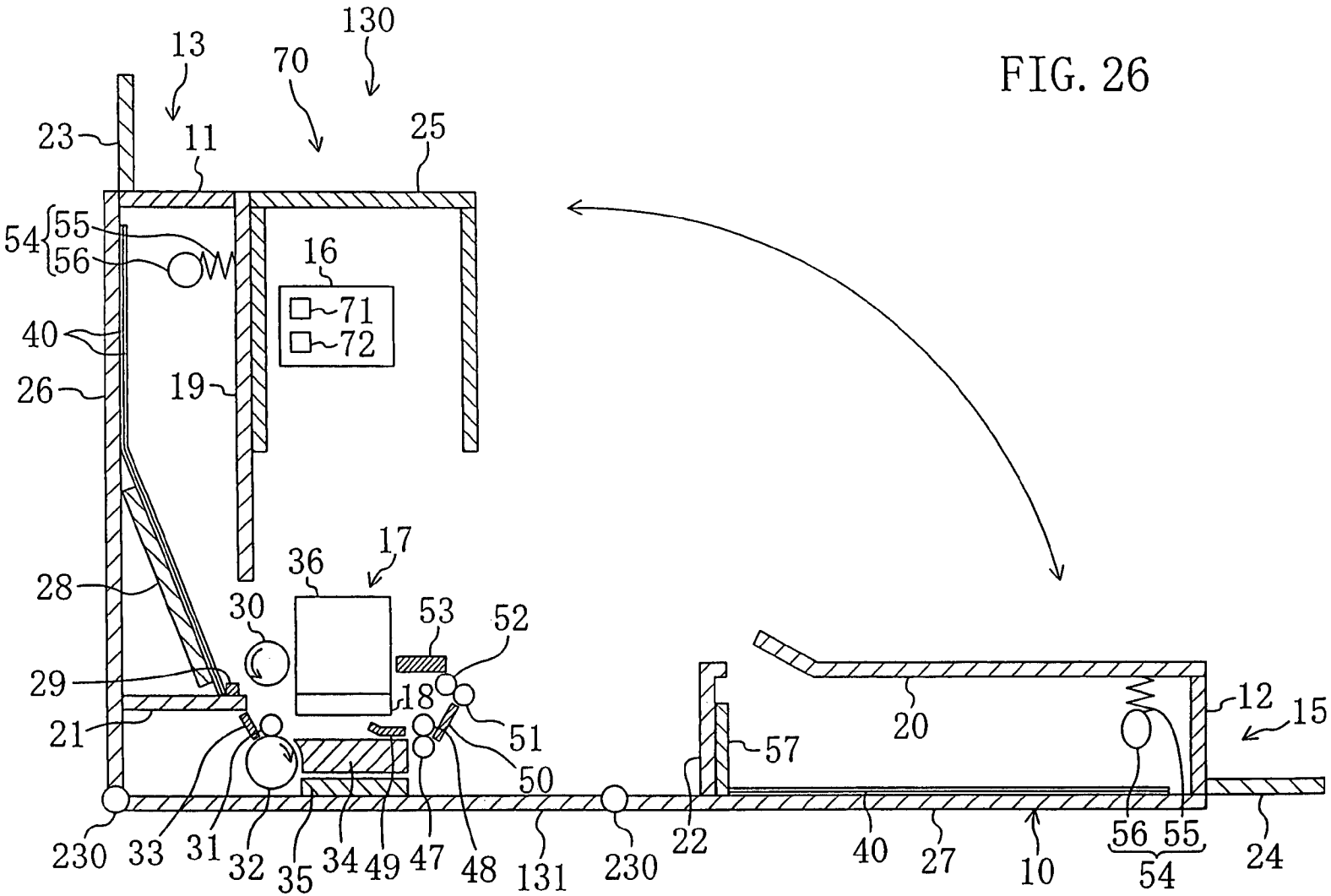
FIG. 26 is a cross-sectional view illustrating a printer with a paper eject section in its open position.

An open/close mechanism 230 is provided at the lower left corner of the casing 10. As illustrated in FIG. 25, the open/close mechanism 230 allows the paper supply section 13 (including the left-side plate 26, the partition plate 19, the partition plate 21, the inclined plate 28, the protrusion 29, etc.) to be pivoted to its right, open position and back to its left, closed position. Similarly, another open/close mechanism 230 is provided at the lower right corner of the casing 10. As illustrated in FIG. 26, the open/close mechanism 230 allows the paper eject section 15 (including the right-side plate 27, the partition plate 22, the partition plate 20, the moving plate 57, etc.) to be pivoted to its right, open position and back to its left, closed position. Each open/close mechanism 230 may be a cylindrical hinge, which may be made of a plastic, a metal, etc. Note however that the type or material of the open/close mechanism 230 is not limited to any particular type or material.

When the ink tank 36 is running out of ink, for example, the paper supply section 13 can be pivoted about the open/close mechanism 230 to the left so that the ink tank 36 can be easily taken out from the ink jet head 18. In a case where the recording section 17 is provided between the paper supply section 13 and the paper eject section 15 and in a lower portion of the printer (i.e., lower than the position half way through the vertical length of the printer), as in the present printer 130, only a small gap is provided between the paper supply section 13 and the paper eject section 15 in order to reduce the thickness of the printer, and it is difficult to put the user's hand into such a small gap. Even then, with the printer 130 of the present embodiment, the ink tank 36 can be replaced easily.

Moreover, when the recording paper 40 gets jammed for some reasons along the path from the paper supply section 13 to the recording section 17 or along the path from the recording section 17 to the paper eject section 15, it may be difficult to put a hand in through the upper surface of the paper supply section 13 or the paper eject section 15. Even then, the recording paper 40 can be easily taken out by opening the paper supply section 13 or the paper eject section 15. Thus, the printer 130 of the present embodiment has a reduced thickness, and yet allows the user to easily replace the ink tank and clear a paper jam.

Figure 27:
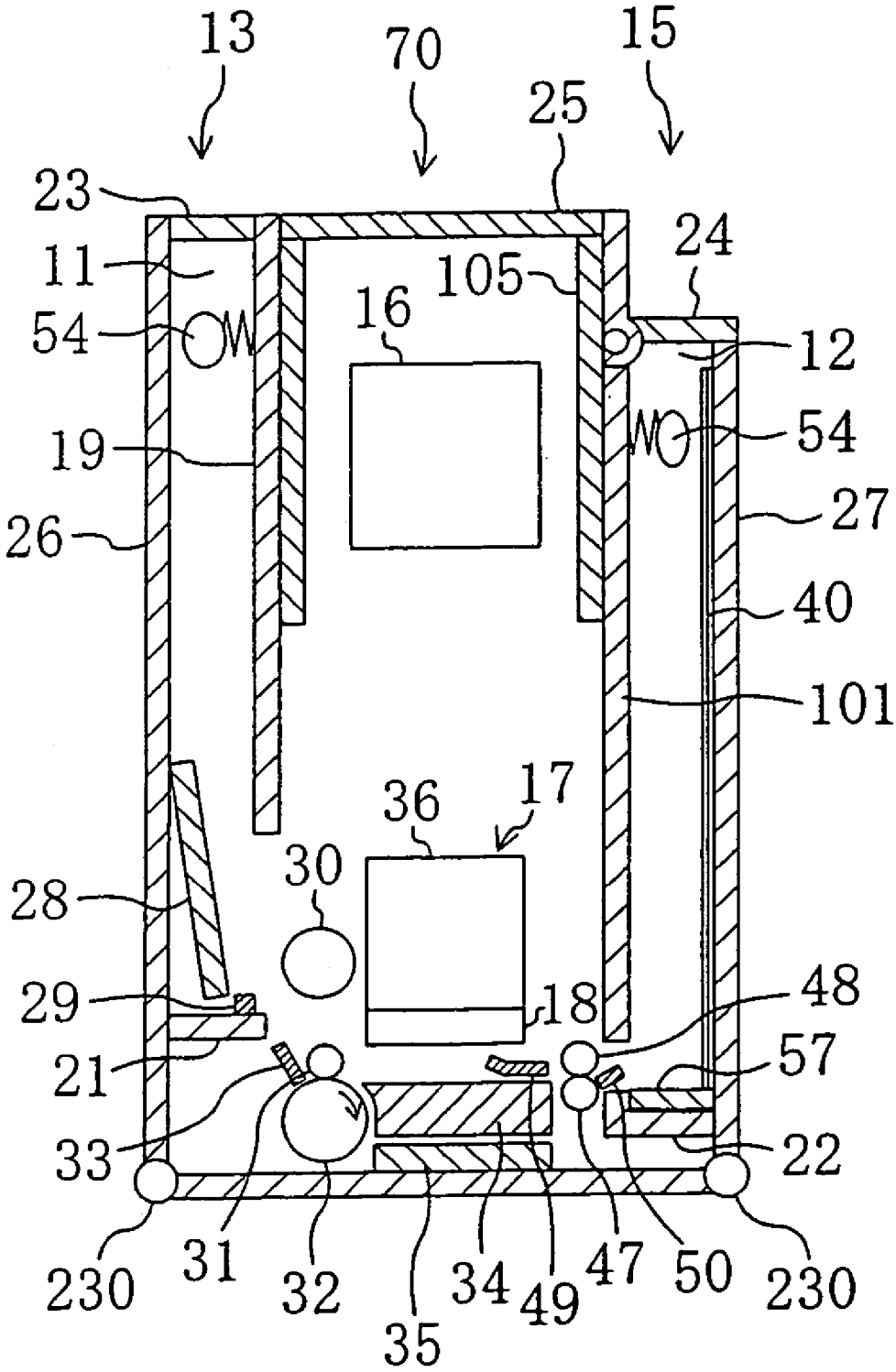
FIG. 27 is a cross-sectional view illustrating a printer.

Note that the application of the open/close mechanism 230 is not limited to Embodiment 1, but the open/close mechanism 230 may be applied to any other embodiment. For example, the open/close mechanism 230 may be provided in the printer 100 of Embodiment 2, as illustrated in FIG. 27.

Alternative Embodiments

Figure 28A:
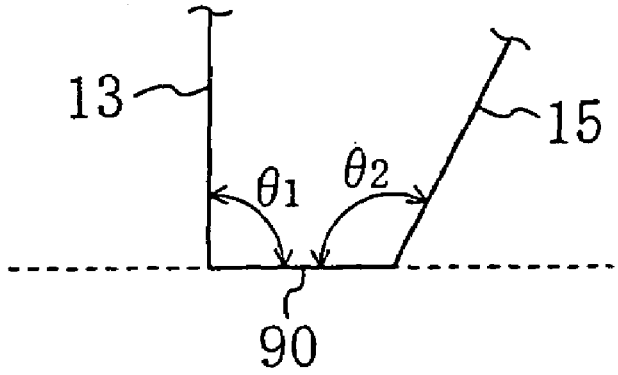
FIG. 28A to FIG. 28C are conceptual diagrams each illustrating the positional relationship among a paper supply section, a paper eject section and the bottom surface of a casing.
Figure 28B:
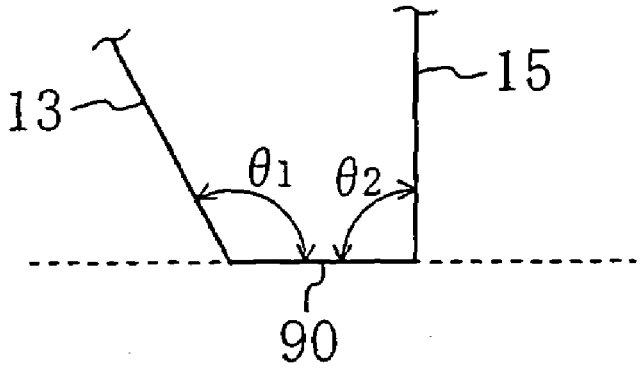
Figure 28C:
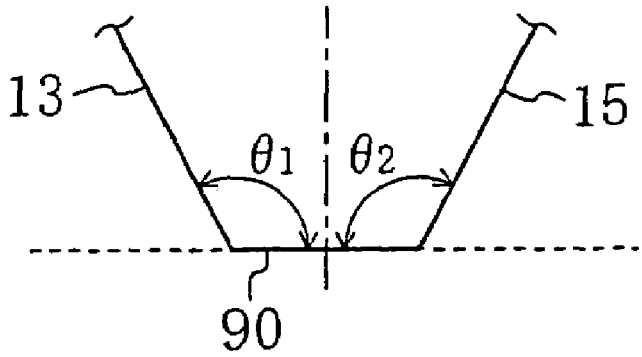
Figure 29A:
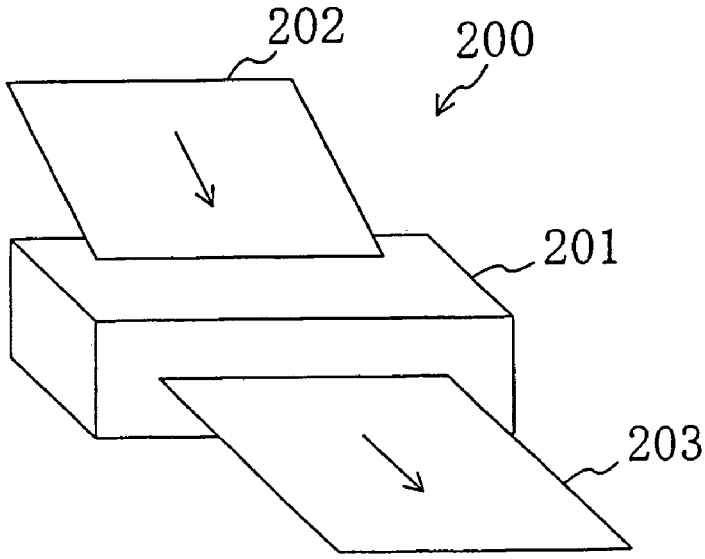
FIG. 29A PRIOR ART
FIG. 29A is a perspective view illustrating a printer.
Figure 29B:
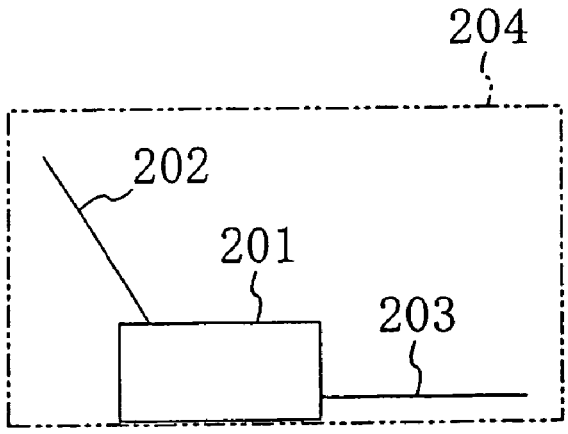
FIG. 29B PRIOR ART
FIG. 29B is a side view illustrating the printer.
Figure 30:
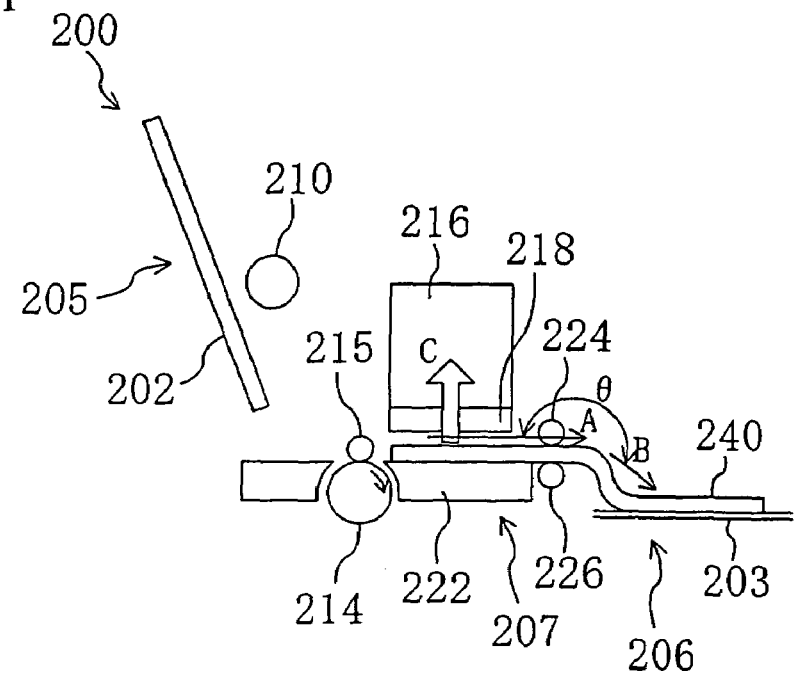
FIG. 30 PRIOR ART
FIG. 30 is a side view illustrating a recording section.
Figure 31:
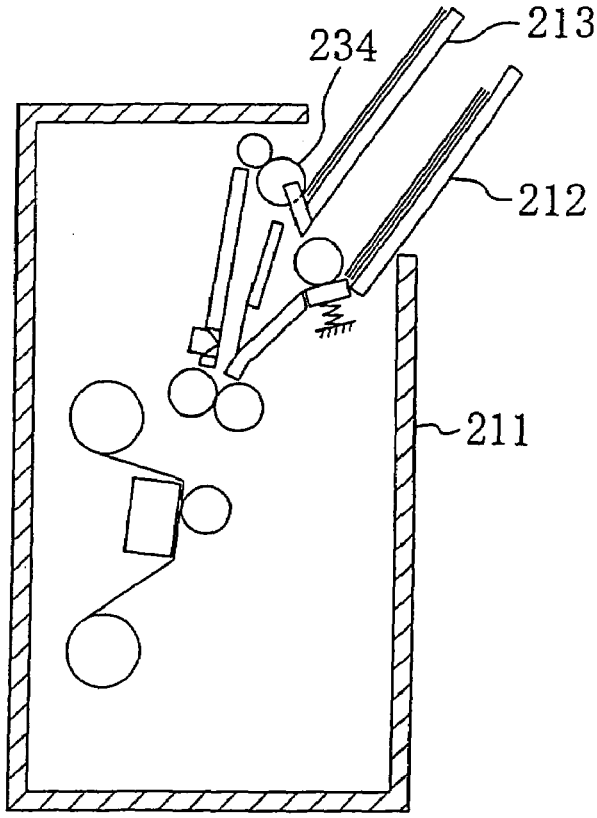
FIG. 31 PRIOR ART
FIG. 31 is a cross-sectional view illustrating an important part of a printer.

In the embodiments above, the longitudinal direction of each of the paper supply section 13 and the paper eject section 15 is perpendicular to the bottom surface of the casing 10. Alternatively, the longitudinal direction of each of the paper supply section 13 and the paper eject section 15 may be at a slanted angle to the bottom surface of the casing 10, as illustrated in FIG. 28A to FIG. 28C, for example. Note however that the longitudinal direction of the paper supply section 13 and that of the paper eject section 15 are preferably not slanted in the same direction in order to ensure a high level of safety of the apparatus. It is preferred that only one of the longitudinal direction of the paper supply section 13 and that of the paper eject section 15 is slanted, or that they are slanted in opposite directions. Specifically, the angle θ1 between the longitudinal direction of the paper supply section 13 and a bottom surface 90 of the casing 10 is preferably 90° to 120°, and the angle θ2 between the longitudinal direction of the paper eject section 15 and the bottom surface 90 of the casing 10 is also preferably 90° to 120°. It is further preferred that the angles θ1 and θ2 are of the same value so as to ensure left-right symmetry, thereby further improving the stability (see FIG. 28C).

The recording head of the recording section 17 is not limited to the ink jet head 18, but may alternatively be any other appropriate head. Note however that a recording head of a non-contact printing type is preferred in order to reduce the size of the recording section 17. For example, the recording head may suitably be a thermal recording head that uses laser light, a toner jet recording head that shoots out toner particles.

The paper supply port 11 or the paper eject port 12 may be facing in a slanted upward direction, and the paper supply section 13 or the paper eject section 15 may extend in a slanted upward direction.

The recording medium is not limited to the recording paper 40, but may alternatively be any other appropriate sheet recording medium such as an OHP transparency film.

The application of the present invention is not limited to printers, but may alternatively be any other appropriate recording apparatuses such as copiers or facsimiles.

The present invention is not limited to the embodiments set forth above, but may be carried out in various other ways without departing from the spirit or main features thereof.

Thus, the embodiments set forth above are merely illustrative in every respect, and should not be taken as limiting. The scope of the present invention is defined by the appended claims, and in no way is limited to the description set forth herein. Moreover, any variations and/or modifications that are equivalent in scope to the claims fall within the scope of the present invention.

What is claimed is:

1. A recording apparatus, comprising:

a recording section for recording information on a recording medium;

a medium carrying mechanism for carrying the recording medium on which information has been recorded by the recording section;

a medium accommodating section extending in a vertical direction or in a slanted vertical direction for accommodating the recording medium carried by the medium carrying mechanism; and a redirecting member for changing a medium carrying direction of the recording medium carried by the medium carrying mechanism, wherein:

the recording section includes a non-contact recording head for recording information on the recording medium, and a platen opposing a head surface of the recording head; and a medium path angle is equal to or greater than 90° and less than 150°, the medium path angle being defined as an angle between the medium carrying direction of the recording medium while the recording medium is on the platen and that after a medium path is changed by the redirecting member, and wherein the redirecting member includes a plate-shaped member that is provided on a downstream side in the medium carrying direction with respect to the platen, and a drive mechanism for pivoting the plate-shaped member to change the medium carrying direction after a leading edge portion of the recording medium has moved onto the plate-shaped member.

* * * * *